US009829835B2

(12) United States Patent
Oba et al.

(10) Patent No.: US 9,829,835 B2
(45) Date of Patent: Nov. 28, 2017

(54) IMAGE FORMING APPARATUS INCLUDING CLEANING MEMBER TO REMOVE RESIDUAL TONER REMAINING ON SURFACE OF INTERMEDIATE TRANSFER BELT

(71) Applicant: KYOCERA Document Solutions Inc., Osaka (JP)

(72) Inventors: Keisuke Oba, Osaka (JP); Satoshi Uemura, Osaka (JP); Kenji Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/420,718

(22) Filed: Jan. 31, 2017

(65) Prior Publication Data

US 2017/0227894 A1 Aug. 10, 2017

(30) Foreign Application Priority Data

Feb. 8, 2016 (JP) ..... 2016-021553
Jun. 27, 2016 (JP) ..... 2016-126968

(51) Int. Cl.
*G03G 15/16* (2006.01)

(52) U.S. Cl.
CPC ..... *G03G 15/1615* (2013.01); *G03G 15/161* (2013.01)

(58) Field of Classification Search
CPC ..... G03G 15/161; G03G 15/1615
USPC ..... 399/101, 302
See application file for complete search history.

(56) References Cited

U.S. PATENT DOCUMENTS 7,609,992 B2 * 10/2009 Kim ..... G03G 15/1615 399/101
9,025,995 B2 * 5/2015 Yoshikawa ..... G03G 15/161 399/101
2013/0089356 A1 4/2013 Yamaki et al. ..... 399/101

FOREIGN PATENT DOCUMENTS

JP 2004-341399 A 12/2004
JP 2013-83676 A 5/2013

* cited by examiner

*Primary Examiner* — William J Royer
(74) *Attorney, Agent, or Firm* — Stein IP, LLC

(57) ABSTRACT

An image forming apparatus of the present disclosure includes a plurality of image forming portions, an intermediate transfer unit, a secondary transfer member, a belt cleaning device, and a control portion. The intermediate transfer unit includes an intermediate transfer belt, a plurality of primary transfer members, a drive roller, a tension roller, and a contacting/separating mechanism. The belt cleaning device includes a cleaning member which faces the tension roller with the intermediate transfer belt therebetween. In a withdrawal mode, the cleaning member is moved by pressing force of the tension roller further into a housing from an opening portion as compared with in a printing mode. The control portion is capable of executing, while image formation is not being performed, a transfer toner collection mode in which the intermediate transfer belt and the belt cleaning device are driven in the withdrawal mode.

17 Claims, 13 Drawing Sheets

IMAGE FORMING APPARATUS INCLUDING CLEANING MEMBER TO REMOVE RESIDUAL TONER REMAINING ON SURFACE OF INTERMEDIATE TRANSFER BELT

INCORPORATION BY REFERENCE

This application is based upon and claims the benefit of priority from the corresponding Japanese Patent Applications No. 2016-21553 filed on Feb. 8, 2016 and No. 2016-126968 filed on Jun. 27, 2016, the entire contents of which are incorporated herein by reference.

BACKGROUND

The present disclosure relates to an image forming apparatus including a mechanism that uses a cleaning member to remove residual toner remaining on a surface of an intermediate transfer belt, and in particular, relates to a method for preventing removed toner from adhering to the intermediate transfer belt again.

Conventionally known image forming apparatuses adopting an intermediate transfer method include an endless intermediate transfer belt which is caused to rotate in a predetermined direction and a plurality of image forming portions arranged along the intermediate transfer belt; the image forming portions form toner images of respective colors, which are primarily transferred sequentially onto the intermediate transfer belt to be superimposed one on another, and then secondarily transferred onto a recording medium.

In such image forming apparatuses adopting the intermediate transfer method, there is arranged a belt cleaning device to remove residual toner from the intermediate transfer belt after the secondary transfer is completed. In a case where the intermediate transfer belt does not include an elastic layer, a blade method is adopted in which toner is scraped off the intermediate transfer belt by pressing a cleaning blade against a surface of the intermediate transfer belt.

On the other hand, in a case where the intermediate transfer belt includes an elastic layer, a cleaning device is often adopted which includes a cleaning brush which mechanically and electrically collects toner remaining on the surface of the intermediate transfer belt, a collection roller which collects toner from the cleaning brush, a blade which scrapes toner off a surface of the collection roller, and a spiral conveyor which conveys toner scraped off the surface of the collection roller into a waste toner collection container.

There have also been proposed various techniques to adjust conditions for cleaning of intermediate transfer belt; for example, a technique is known in which an adjustment mechanism is used which adjusts contact conditions in which a cleaning member and an intermediate transfer belt contact each other, in order to adjust the contact conditions to be suitable in each of a monochrome mode and a color mode.

There is also known a technique for preventing soiling of the back of a recording medium, in which, in switching from color mode to monochrome mode, primary transfer means of each image forming portion is once released from a state in which it is pressed in contact with an intermediate transfer belt and then the primary transfer means of such one of the image forming portions in which image forming is performed in the monochrome mode is pressed into contact with the intermediate transfer belt.

SUMMARY

According to an aspect of the present disclosure, an image forming apparatus includes a plurality of image forming portions which form images of different colors, an intermediate transfer unit, a secondary transfer member, a belt cleaning device, and a control portion. The intermediate transfer unit includes an intermediate transfer belt which has an endless shape and moves along the plurality of image forming portions, a plurality of primary transfer members which are arranged to face image carriers arranged in the image forming portions, with the intermediate transfer belt between the primary transfer members and the image carriers, and which transfer toner images formed on the image carriers onto the intermediate transfer belt, a drive roller which causes the intermediate transfer belt to turn, a tension roller which rotates following the intermediate transfer belt and gives a predetermined tension to the intermediate transfer belt, and a contacting/separating mechanism which causes the primary transfer members to reciprocate in directions toward and away from the intermediate transfer belt. The secondary transfer member secondarily transfers, onto a recording medium, the toner images which have been primarily transferred onto the intermediate transfer belt. The belt cleaning device removes residual toner on a surface of the intermediate transfer belt. The control portion controls driving of the intermediate transfer unit and driving of the belt cleaning device. The contacting/separating mechanism is switchable between a printing mode in which at least one of the primary transfer members is pressed against one of the image carriers with the intermediate transfer belt therebetween and a withdrawal mode in which all the primary transfer members are separated from the image carriers. The belt cleaning device includes a housing having formed therein an opening portion which faces the intermediate transfer belt and a toner storage portion for storing toner removed from the surface of the intermediate transfer belt, a cleaning member arranged at a position facing the tension roller with the intermediate transfer belt between the cleaning member and the tension roller, a collection roller which collects toner adhered to the cleaning member, and a seal member which is arranged to face the collection roller along an entire length of the collection roller and functions as a partition between the toner storage portion and the opening portion. In the withdrawal mode, the cleaning member is moved by pressing force of the tension roller further into the housing from the opening portion as compared with in the printing mode. The control portion is capable of executing, while image formation is not being performed, a transfer toner collection mode in which the intermediate transfer belt and the belt cleaning device are driven in the withdrawal mode to collect toner accumulated in vicinity of the opening portion of the housing by using the cleaning member and the collection roller.

Further features and specific advantages of the present disclosure will become apparent from the following descriptions of preferred embodiments.

DETAILED DESCRIPTION

Figure 1:
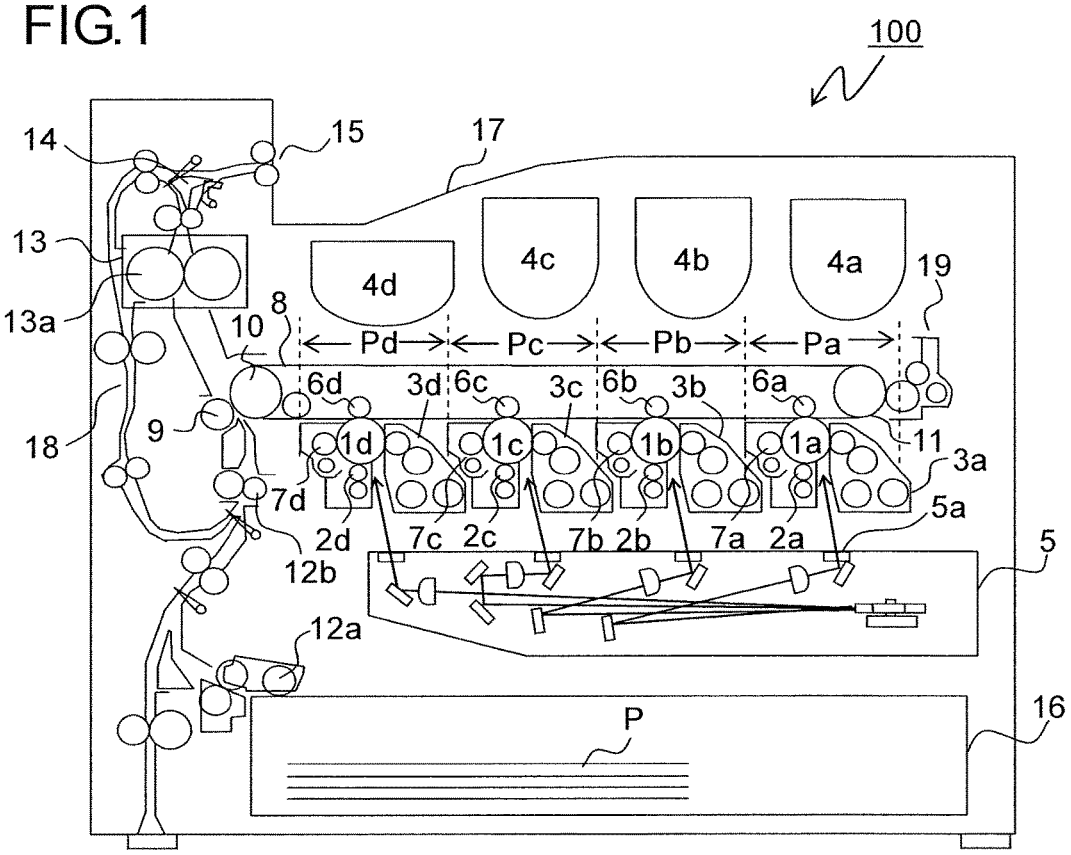
FIG. 1 is a schematic diagram illustrating an internal configuration of an image forming apparatus according to a first embodiment of the present disclosure.
Figure 2:
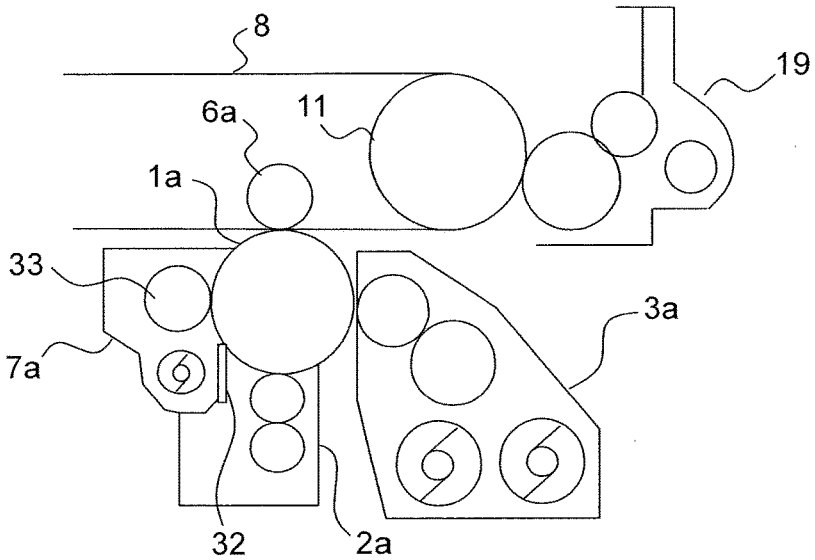
FIG. 2 is an enlarged diagram illustrating an image forming portion illustrated in FIG. 1 and vicinity thereof.

Hereinafter, embodiments of the present disclosure will be described with reference to the drawings. FIG. 1 is a schematic diagram illustrating an internal configuration of an image forming apparatus 100 according to a first embodiment of the present disclosure, and FIG. 2 is an enlarged diagram illustrating an image forming portion Pa illustrated in FIG. 1 and the vicinity thereof.

The image forming apparatus 100 illustrated in FIG. 1 is what is called a tandem color printer, and has a configuration as described below. In a main body of the image forming apparatus 100, image forming portions Pa, Pb, Pc, and Pd are arranged in this order from an upstream side in a conveyance direction (right side in FIG. 1). The image forming portions Pa to Pd are provided corresponding to images of four different colors (cyan, magenta, yellow, and black), and sequentially form images of cyan, magenta, yellow, and black through charging, exposure, developing, and transferring steps.

In the image forming portions Pa, Pb, Pc, and Pd, there are disposed photosensitive drums 1*a*, 1*b*, 1*c*, and 1*d*, respectively, each for carrying a visible image (toner image) of a corresponding color, and further, an intermediate transfer belt 8, which is caused to rotate by driving means (not shown) in a clockwise direction in FIG. 1, is disposed adjacent to the image forming portions Pa to Pd.

Transfer sheets P, onto which toner images are to be transferred, are stored in a sheet cassette 16 disposed in a lower part of the main body of the image forming apparatus 100, and are to be conveyed via a sheet feeding roller 12*a* and a registration roller pair 12*b* to a secondary transfer roller 9. Mainly used as the intermediate transfer belt 8 is a (seamless) belt having no seam.

Next, the image forming portions Pa to Pd will be described. The following description will deal with details of the image forming portion Pa, and as for the image forming portions Pb to Pd, which each have basically the same configuration as the image forming portion Pa, descriptions thereof will be omitted. As illustrated in FIG. 2, around the photosensitive drum 1*a*, a charging device 2*a*, a developing device 3*a*, and a cleaning device 7*a* are arranged along a drum rotation direction (a counterclockwise direction in FIG. 1), and a primary transfer roller 6*a* is arranged to face the photosensitive drum 1*a* with the intermediate transfer belt 8 therebetween. Further, on an upstream side in a rotation direction of the intermediate transfer belt 8 with respect to the photosensitive drum 1*a*, a belt cleaning unit 19 is arranged to face a tension roller 11 with the intermediate transfer belt 8 therebetween.

Next, a description will be given of an image forming procedure in the image forming apparatus 100. When a user inputs an instruction to start image formation, firstly surfaces of the photosensitive drums 1*a* to 1*d* are uniformly charged by the charging devices 2*a* to 2*d*. Next, surface of the photosensitive drums 1*a* to 1*d* are irradiated with a light beam (laser light) emitted through a light emitting window 5*a* of an exposure device 5 to form electrostatic latent images on the photosensitive drums 1*a* to 1*d* corresponding to an image signal. Developing devices 3*a* to 3*d* are each filled with a two-component developer containing cyan, magenta, yellow, or black toner. Note that, the developing devices 3*a* to 3*d* are supplied with toner from toner containers 4*a* to 4*d* when the proportion of toner contained in the two-component developer in each of the developing devices 3*a* to 3*d* falls below a regulation value after formation of toner images, which will be described below. The toner contained in the developer is supplied onto the photosensitive drums 1*a* to 1*d* by the developing devices 3*a* to 3*d*, and electrostatically adheres thereto to form toner images corresponding to the electrostatic latent images formed through exposure to the light from the exposure device 5.

Then, by primary transfer rollers 6*a* to 6*d*, an electric field is applied at a predetermined transfer voltage between the primary transfer rollers 6*a* to 6*d* and the photosensitive drums 1*a* to 1*d*, respectively, and the toner images of cyan, magenta, yellow, and black on the photosensitive drums 1*a* to 1*d* are primarily transferred onto the intermediate transfer belt 8. The toner images of the four colors are formed with a predetermined positional relationship therebetween that is previously determined for forming a predetermined full-color image. Thereafter, in preparation for formation of new electrostatic latent images to be subsequently performed, toners remaining on the surfaces of the photosensitive drums 1*a* to 1*d* are removed by the cleaning devices 7*a* to 7*d*.

When the intermediate transfer belt 8 starts to rotate in a clockwise direction along with rotation of a driving roller 10 caused by a belt driving motor (not shown), a transfer sheet P is conveyed from the registration roller pair 12*b* with a predetermined timing to the secondary transfer roller 9, which is provided adjacent to the intermediate transfer belt 8, and there, a full-color image is secondarily transferred onto the transfer sheet P. The transfer sheet P, onto which the toner image has been transferred, is then conveyed to a fixing portion 13. Residual toner remaining on the surface of the intermediate transfer belt 8 is removed by the belt cleaning unit 19.

The transfer sheet P, which has been conveyed to the fixing portion 13, is heated and pressurized by a fixing roller pair 13*a*, whereby the toner image is fixed on the surface of the transfer sheet P, and thus a predetermined full-color image is formed. The transfer sheet P, on which the full-color image has been formed, is discharged onto a discharge tray 17 by a discharge roller 15 as it is (or after being directed by a branching portion 14 into a reverse conveyance path 18 and having an image formed on the other side thereof, too).

Figure 3:
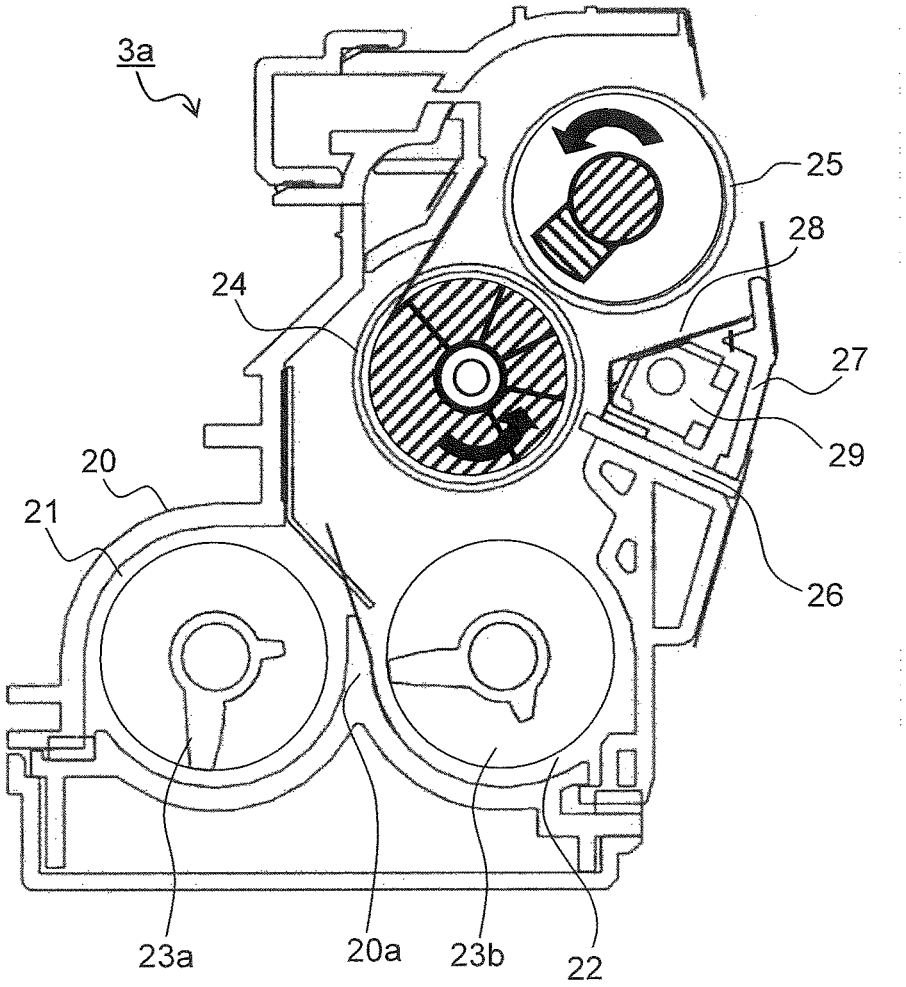
FIG. 3 is a side sectional view of a developing device incorporated in the image forming apparatus of the first embodiment.

FIG. 3 is a side sectional view of the developing device 3*a* incorporated in the image forming apparatus 100 of the first embodiment. FIG. 3 illustrates the developing device 3*a* as seen from back sides of FIGS. 1 and 2, and accordingly the arrangement of components in the developing device 3*a* appears to be left-right reversal to in FIGS. 1 and 2. Further, in the following description, only the developing device 3*a* arranged in the image forming portion Pa will be dealt with as an example, and the developing devices 3*b* to 3*d* arranged in the image forming portions Pb to Pd are not described. This is because each of the developing devices 3*b* to 3*d* has basically the same structure as the developing device 3*a*.

As illustrated in FIG. 3, the developing device 3*a* includes a developing container (a casing) 20 in which to store a two-component developer (hereinafter, simply referred to as developer) composed of a toner and a magnetic carrier. The developing container 20 is divided by a partition wall 20*a* into a stirring conveyance chamber 21 and a supply conveyance chamber 22. In the stirring conveyance chamber 21 and the supply conveyance chamber 22, there are rotatably disposed a stirring conveyance screw 23*a* and a supply conveyance screw 23*b*, respectively, both for mixing and stirring toner (positively charged toner) fed from the toner container 4*a* (see FIG. 1) with the carrier to electrostatically charge the toner.

Inside the developing container 20, a toner supply roller 24 (a developer carrier) is arranged above the supply conveyance screw 23*b*, and a developing roller 25 is arranged to the upper right of the toner supply roller 24. The developing roller 25 faces the photosensitive drum 1*a* (see FIG. 2) on an open side (the right in FIG. 3) of the developing container 20, and the toner supply roller 24 and the developing roller 25 rotate in a counterclockwise direction in FIG. 3. To the developing container 20, there is fitted a trimming blade 26 along a longitudinal direction of the toner supply roller 24 (a direction perpendicular to the surface of sheet on which FIG. 3 is drawn).

The developer circulates in the stirring conveyance chamber 21 and the supply conveyance chamber 22 inside the developing container 20 while being stirred by the stirring conveyance screw 23*a* and the supply conveyance screw 23*b*, whereby the toner is electrostatically charged, and the developer is conveyed to the toner supply roller 24 by the supply conveyance screw 23*b*, and forms a magnetic brush (not shown) on the toner supply roller 24. The magnetic brush on the toner supply roller 24 is regulated in thickness by the trimming blade 26. Thereafter, the magnetic brush is conveyed to a position where the toner supply roller 24 and the developing roller 25 face each other, and caused to form a thin layer of toner on the developing roller 25 by potential difference ΔV between Vmag (DC) applied to the toner supply roller 24 and Vslv (DC) applied to the developing roller 25 and a magnetic field.

The thin layer of toner formed on the developing roller 25 through contact with the magnetic brush on the toner supply roller 24 is conveyed by rotation of the developing roller 25 to an opposing part (an opposing region) where the photosensitive drum 1*a* and the developing roller 25 face each other. Since Vslv (DC) and Vslv (AC) are applied to the developing roller 25, the potential difference from the photosensitive drum 1*a* causes toner to fly from the developing roller 25 to the photosensitive drum 1*a*, to develop an electrostatic latent image on the photosensitive drum 1*a*.

Provided on a right-side wall of the developing container 20 in FIG. 3, in the vicinity of the developing roller 25, there is provided a toner receiver support member 27, which has a triangular shape in section and projects into the developing container 20. As illustrated in FIG. 3, the toner receiver support member 27 is arranged along the longitudinal direction of the developing container 20 (a direction perpendicular to the sheet on which FIG. 3 is drawn), and an upper surface of the toner receiver support member 27 faces the toner supply roller 24 and the developing roller 25, and defines a wall sloping down in a direction from the developing roller 25 toward the toner supply roller 24. To the upper surface of the toner receiver support member 27, there is fitted a toner receiver member 28 along the longitudinal direction of the toner receiver support member 27, and receives toner removed from the developing roller 25 to drop. At a substantially center part of the toner receiver member 28 in its longitudinal direction, there is provided a vibration generating device 29. Inside the vibration generating device 29, there is arranged an unillustrated vibration motor, which is driven to generate vibration. The vibration generated by the vibration generating device 29 is transmitted to the toner receiver member 28.

If toner accumulated around the trimming blade 26 or the toner receiver support member 27 coagulates and adheres to the developing roller 25, the coagulated toner may move to the photosensitive drum 1*a* and cause a defective image. To prevent this, the image forming apparatus 100 of the present embodiment is capable of executing a development toner collection mode, while image formation is not being performed, in which the toner receiver member 28 in each of the developing devices 3*a* to 3*d* is caused to vibrate by the vibration generating device 29 to shake off toner accumulated on the toner receiver member 28 to be collected in the supply conveyance chamber 22.

Figure 4:
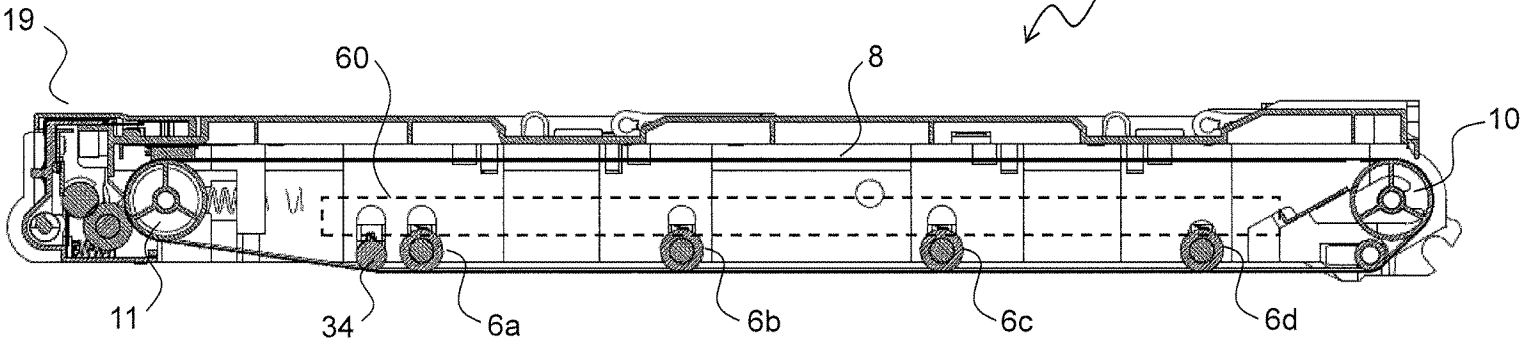
FIG. 4 is a side sectional view of an intermediate transfer unit incorporated in the image forming apparatus of the first embodiment.

FIG. 4 is a side sectional view of an intermediate transfer unit 30 incorporated in the image forming apparatus 100 of the first embodiment. Illustrated in FIG. 4 is the intermediate transfer unit 30 as seen from the back side of FIG. 1. As illustrated in FIG. 4, the intermediate transfer unit 30 includes the intermediate transfer belt 8, which is wound around and between the driving roller 10 on the downstream side and the tension roller 11 on the upstream side, primary transfer rollers 6*a* to 6*d* contacting the photosensitive drums 1*a* to 1*d* via the intermediate transfer belt 8, and a pressure switching roller 34. Further, arranged at a position facing the tension roller 11 is the belt cleaning unit 19 for removing toner remaining on the surface of the intermediate transfer belt 8. The configuration of the belt cleaning unit 19 will be described later in detail.

The intermediate transfer unit 30 further includes a roller contacting/separating mechanism 60 having a pair of support members (not shown) and driving means (not shown).

The support members support both end parts of each of rotation shafts of the primary transfer rollers 6*a* to 6*d* and of the pressure switching roller 34 to be rotatable and also movable perpendicularly (in the up-down direction in FIG. 4) with respect to a direction in which the intermediate transfer belt 8 moves. The driving means make the pressure switching roller 34 reciprocate in the up-down direction. The roller contacting/separating mechanism 60 is capable of switching the four primary transfer rollers 6*a* to 6*d* between a color mode, a monochrome mode, and a withdrawal mode. In the color mode, the primary transfer rollers 6*a* to 6*d* are respectively pressed against the photosensitive drums 1*a* to 1*d* (see FIG. 1) via the intermediate transfer belt 8. In the monochrome mode, only the primary transfer roller 6*d* is pressed against the photosensitive drum 1*d* via the intermediate transfer belt 8. In the withdrawal mode, all the primary transfer rollers 6*a* to 6*d* are separated from the intermediate transfer belt 8.

Specifically, the roller contacting/separating mechanism 60 moves the pressure switching roller 34 upward to thereby move the primary transfer rollers 6*a* to 6*d* upward together with the intermediate transfer belt 8, as a result of which the primary transfer rollers 6*a* to 6*d* are separated from the photosensitive drums 1*a* to 1*d*. Here, the pressure switching roller 34 is arranged closer to the tension roller 11 than the primary transfer roller 6*a* is, and thus, a lower surface (the surface contacting the photosensitive drums 1*a* to 1*d*) swings up and down with its driving-roller-10 side as a fulcrum. As a result, the distance between the intermediate transfer belt 8 and each of the photosensitive drums 1*a* to 1*d* is maximum on the photosensitive-drum-1*a* side and minimum on the photosensitive-drum-1*d* side.

Figure 5:
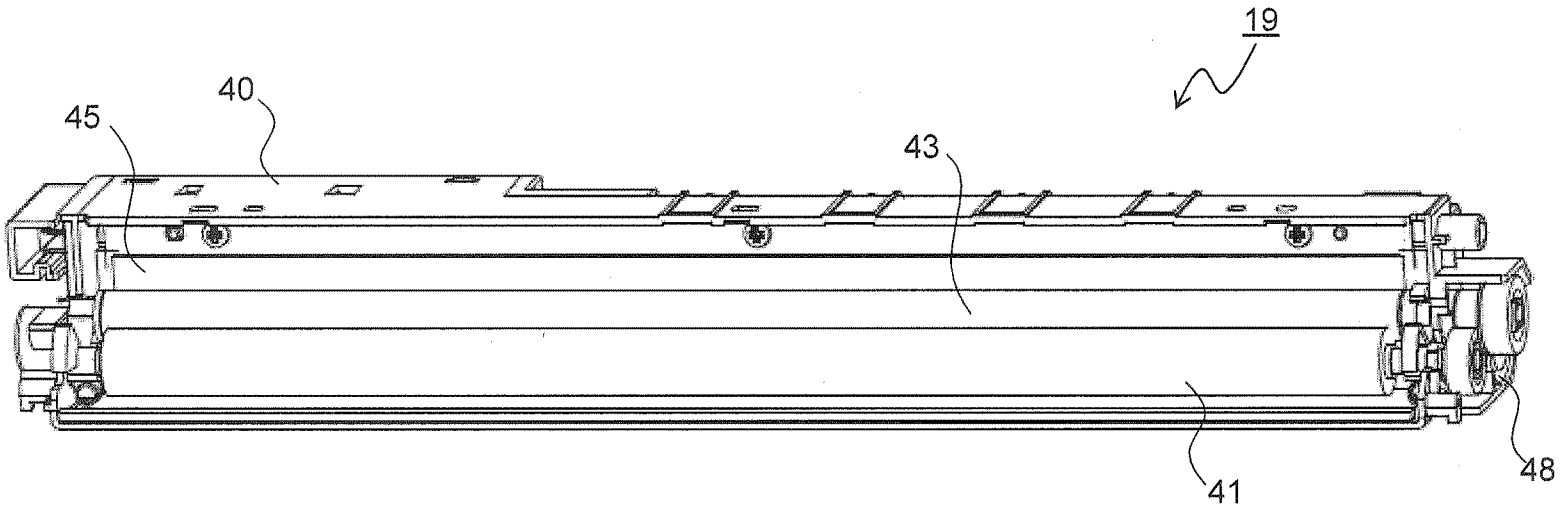
FIG. 5 is an external perspective view of a belt cleaning unit illustrated in FIG. 4.
Figure 6:
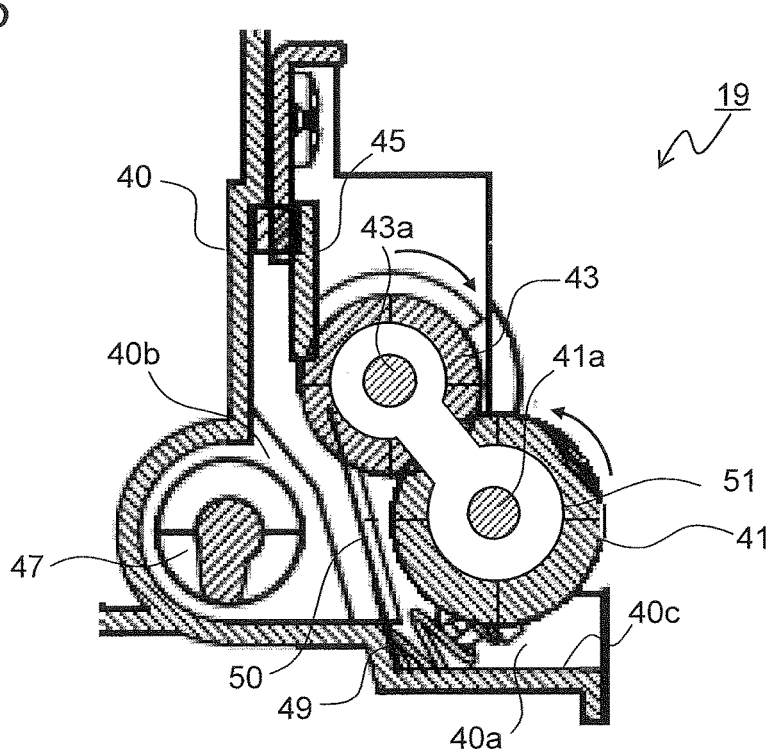
FIG. 6 is a side sectional view of the belt cleaning unit, illustrating an internal configuration thereof.

FIG. 5 is an external perspective view of the belt cleaning unit 19 illustrated in FIG. 4, and FIG. 6 is a side sectional view of the belt cleaning unit 19, illustrating an internal configuration thereof. The belt cleaning unit 19 includes a housing 40, inside which a fur brush 41, a collection roller 43, a blade 45, and a spiral conveyor 47 are arranged. At one end of the housing 40, there is arranged a drive input gear train 48, which inputs driving force from a cleaning driving motor (not shown) to the fur brush 41, the collection roller 43, and the spiral conveyor 47.

The fur brush 41 is arranged to face the tension roller 11 via the intermediate transfer belt 8, on an opening-portion-40*a* side of the housing 40. The fur brush 41 rotates in a counter direction (the counterclockwise direction in FIG. 6) with respect to the direction in which the intermediate transfer belt 8 moves, and thereby scrapes off foreign objects (hereinafter, toner and the like), such as toner and paper powder remaining on the intermediate transfer belt 8. A brush portion of the fur brush 41 contacting the collection roller 43 is formed of a conductive fiber having a resistance of about 1 to 900 MΩ.

The collection roller 43 rotates, contacting a surface of the fur brush 41, in a direction (the clockwise direction in FIG. 6) opposite to the direction in which the fur brush 41 rotates, and thereby collects toner and the like adhered to the fur brush 41. Connected to the collection roller 43 is a cleaning bias power supply 65 (see FIG. 8) to apply a cleaning bias, which has a polarity (here, negative) opposite to that of toner, to the collection roller 43 during cleaning of the intermediate transfer belt 8. Further, the tension roller 11 is grounded (earthed). As a result, toner and the like scraped off the intermediate transfer belt 8 are electrically and mechanically collected by the brush portion of the fur brush 41, and further electrically moves to the collection roller 43.

Rotation shafts 41*a* and 43*a* of the fur brush 41 and the collection roller 43, respectively, are rotatably supported by a bearing member 51, and the fur brush 41 is swingable about the rotation shaft 43*a* of the collection roller 43. A swingable-end side (rotation-shaft-41*a* side) of the bearing member 51 is biased in an upper-rightward direction by a compression spring 49.

The blade 45 cleans the collection roller 43 by contacting the collection roller 43 from an upstream side with respect to the rotation direction of the collection roller 43 (a direction opposite to the moving direction of the surface of the collection roller 43) to scrape off toner and the like collected by the collection roller 43. The spiral conveyor 47 is arranged inside a toner storage portion 40*b* of the housing 40, and conveys toner and the like scraped from the collection roller 43 by the blade 45 to a waste toner collection container (not shown) which is located outside the housing 40.

As illustrated in FIG. 6, inside the housing 40, a seal member 50 is arranged to face the collection roller 43 over a whole length of the collection roller 43. The seal member 50 is a sheet member made of, for example, polyurethane, and the like, and contacts the collection roller 43 with a predetermined contact pressure. The contact pressure of the seal member 50 needs to be set such that the seal member 50 does not scrape off toner adhered to the collection roller 43 and prevents toner and the like scraped off by the blade 45 from moving back toward the collection roller 43.

As already described above, if paper powder adhered to the intermediate transfer belt 8 is conveyed via the fur brush 41 and the collection roller 43 to adhere to the seal member 50, the adhesion of the paper powder causes a gap between the collection roller 43 and the seal member 50, and the gap disadvantageously allows the toner and the like in the toner storage portion 40*b* to flow back toward the opening portion 40*a* to accumulate on the seal member 50 or a bottom surface 40*c* of the housing 40. If the thus accumulated toner and the like adhere to the fur brush 41 again and move onto the intermediate transfer belt 8, it may result in falling of toner onto an image.

Thus, the image forming apparatus 100 of the present embodiment is made capable of executing a transfer toner collection mode, in which the fur brush 41 is used to collect the toner and the like accumulated on the seal member 50 or on the bottom surface 40*c* of the housing 40.

Figure 7:
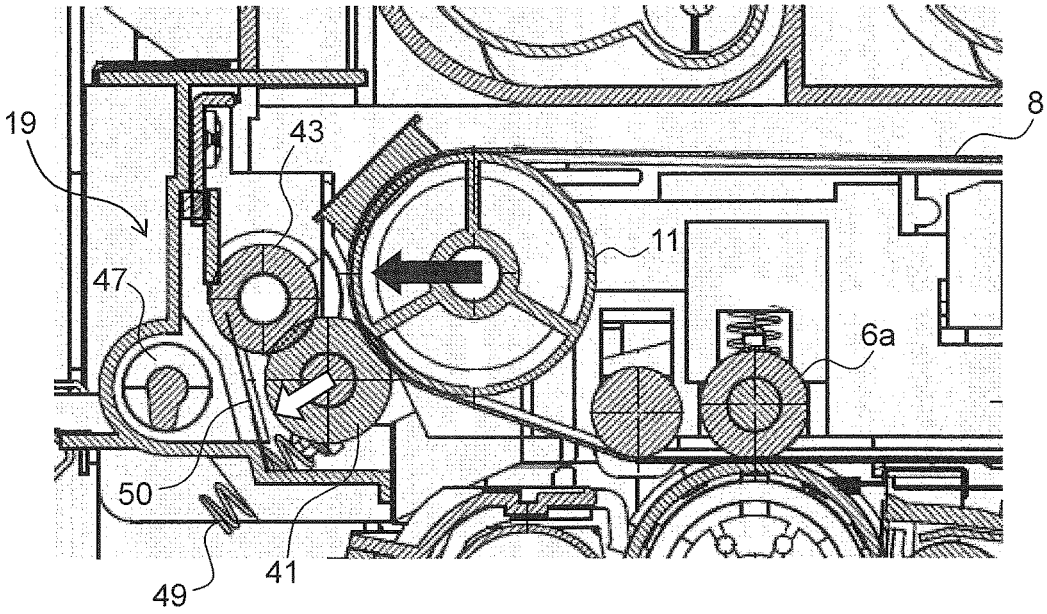
FIG. 7 is a side sectional view for illustrating directions in which a tension roller and a fur brush are caused to move when pressing of the primary transfer rollers is released.

Specifically, switching is performed to the withdrawal mode, in which the roller contacting/separating mechanism 60 moves the primary transfer rollers 6*a* to 6*d* away from the photosensitive drums 1*a* to 1*d*. Thereby, tension applied to the intermediate transfer belt 8 from the primary transfer rollers 6*a* to 6*d* is slightly released to allow the tension roller 11 to move in a direction (indicated by the black arrow in FIG. 7) approaching the fur brush 41 as illustrated in FIG. 7. As a result, the fur brush 41 is pressed by the tension roller 11 to move in a direction (indicated by the white arrow in FIG. 7) approaching the seal member 50 and the bottom surface 40*c* of the housing 40 against the biasing force of the compression spring 49, and thus the toner and the like accumulated on the seal member 50 or the bottom surface 40*c* of the housing 40 are collected by the fur brush 41.

Figure 8:
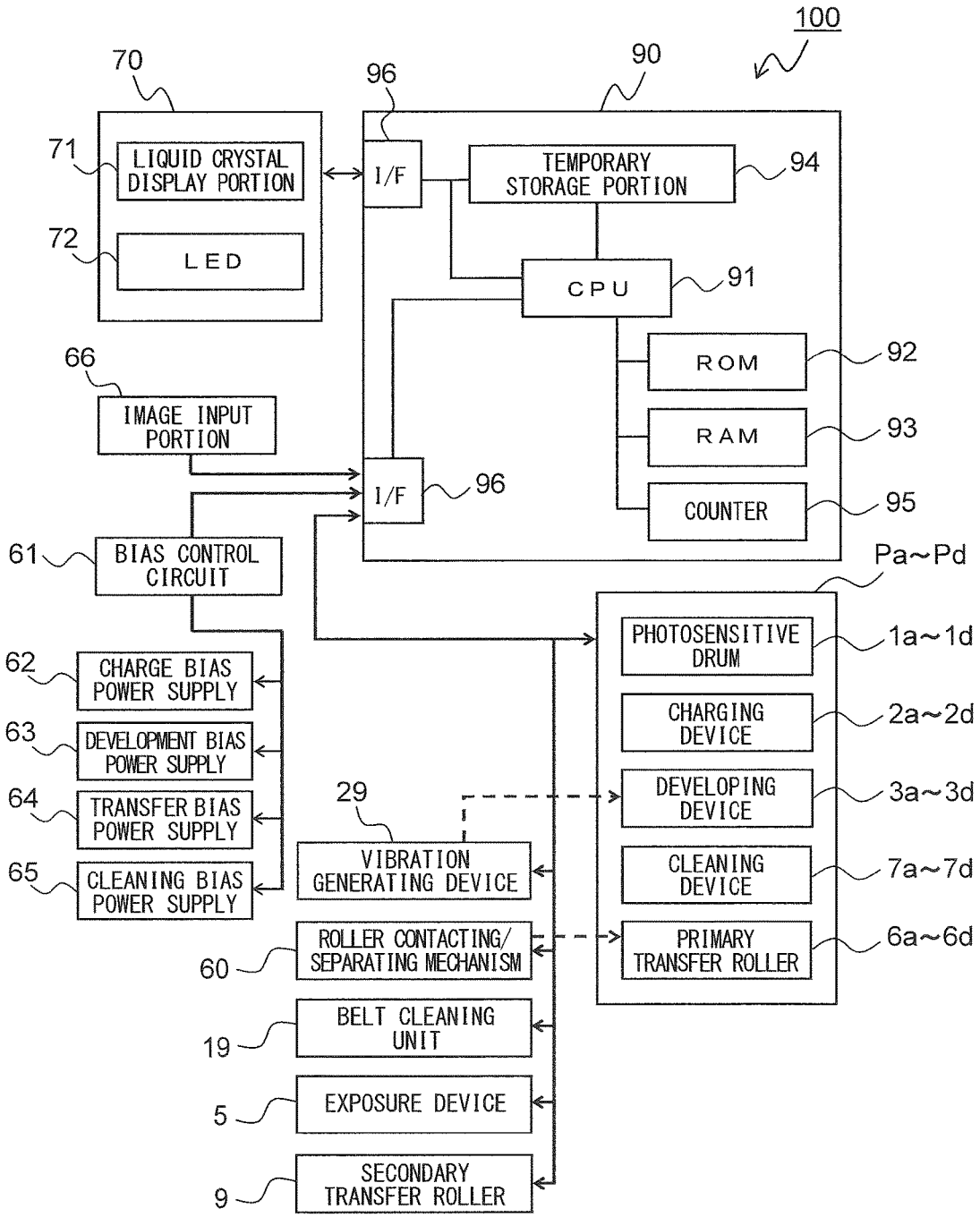
FIG. 8 is a block diagram illustrating control paths in the image forming apparatus according to the first embodiment.

FIG. 8 is a block diagram illustrating control paths of the image forming apparatus 100 of the first embodiment. Note that the operation of the image forming apparatus 100 is achieved by controlling various portions and units in the image forming apparatus 100, and thus the control paths in the entire image forming apparatus 100 are complex. Thus, the following description will be focused on such part of the control paths as is necessary to practice the present disclosure.

A bias control circuit 61 is connected to a charge bias power supply 62, a development bias power supply 63, a transfer bias power supply 64, and the cleaning bias power supply 65, and operates these power supplies based on signals from a control portion 90. Based on control signals from the bias control circuit 61, the charge bias power supply 62 applies a predetermined bias to a charging roller in each of the charging devices 2*a* to 2*d*, the development bias power supply 63 applies a predetermined bias to the toner supply roller 24 and the developing roller 25 in each of the developing devices 3*a* to 3*d*, the transfer bias power supply 64 applies a predetermined bias to the primary transfer rollers 6*a* to 6*d* and the secondary transfer roller 9, and the cleaning bias power supply 65 applies a predetermined bias to the collection roller 43 inside the belt cleaning unit 19.

An image input portion 66 is a receiving portion that receives image data transmitted to the image forming apparatus 100 from a personal computer, and the like. An image signal received by the image input portion 66 is converted into a digital signal, which is then transmitted to a temporary storage portion 94.

An operation portion 70 includes a liquid crystal display portion 71 and an LED 72 indicating various states, such as the state of the image forming apparatus 100, the state of image formation, and the number of copies printed. Various settings regarding the image forming apparatus 100 is set through a printer driver of a personal computer.

In addition, the operation portion 70 includes a start button via which a user gives an instruction to start image formation, a stop/clear button used, for example, to discontinue image formation, a reset button used to reset the image forming apparatus 100 to its default settings, and the like.

The control portion 90 includes at least a central processing unit (CPU) 91, a read only memory (ROM) 92, which is a storage portion dedicated to reading, a random access memory (RAM) 93, which is a readable and writable storage portion, the temporary storage portion 94, which temporarily stores image data and the like, a counter 95, and a plurality of (here, two) interfaces (I/Fs) 96, which transmit control signals to respective devices in the image forming apparatus 100 and receive input signals from the operation portion 70.

The ROM 92 stores programs for control of the image forming apparatus 100, numeral values and the like necessary for the control, such data is not to be changed while the image forming apparatus 100 is being used, and the like. The RAM 93 stores necessary data generated in the course of control of the image forming apparatus 100, data temporarily necessary for control of the image forming apparatus 100, and the like. The RAM 93 (or the ROM 92) stores threshold values for number of copies printed, which function as triggers for execution of the transfer toner collection mode and the development toner collection mode, which will be described later. The temporary storage portion 94 temporarily stores an image signal that has been input via the image input portion 66 and converted into a digital signal. The counter 95 counts and accumulates the number of printed sheets. Here, as will be described later, the counter 95 includes a vibration control counter for controlling driving of the vibration generating device 29, and a belt separation control counter for controlling separation of the intermediate transfer belt 8 caused by the roller contacting/separating mechanism 60, and the counters are independently operable to count up and independently resettable.

The control portion 90 transmits control signals to portions and devices in the image forming apparatus 100 from the CPU 91 via the I/Fs 96. The portions and the devices transmit signals indicating states thereof and input signals to the CPU 91 via the I/Fs 96. Examples of the portions and devices controlled by the control portion 90 include, for example, the image forming portions Pa to Pd, the exposure device 5, the belt cleaning unit 19, the vibration generating device 29, the roller contacting/separating mechanism 60, the bias control circuit 61, the image input portion 66, and the operation portion 70.

Figure 9:
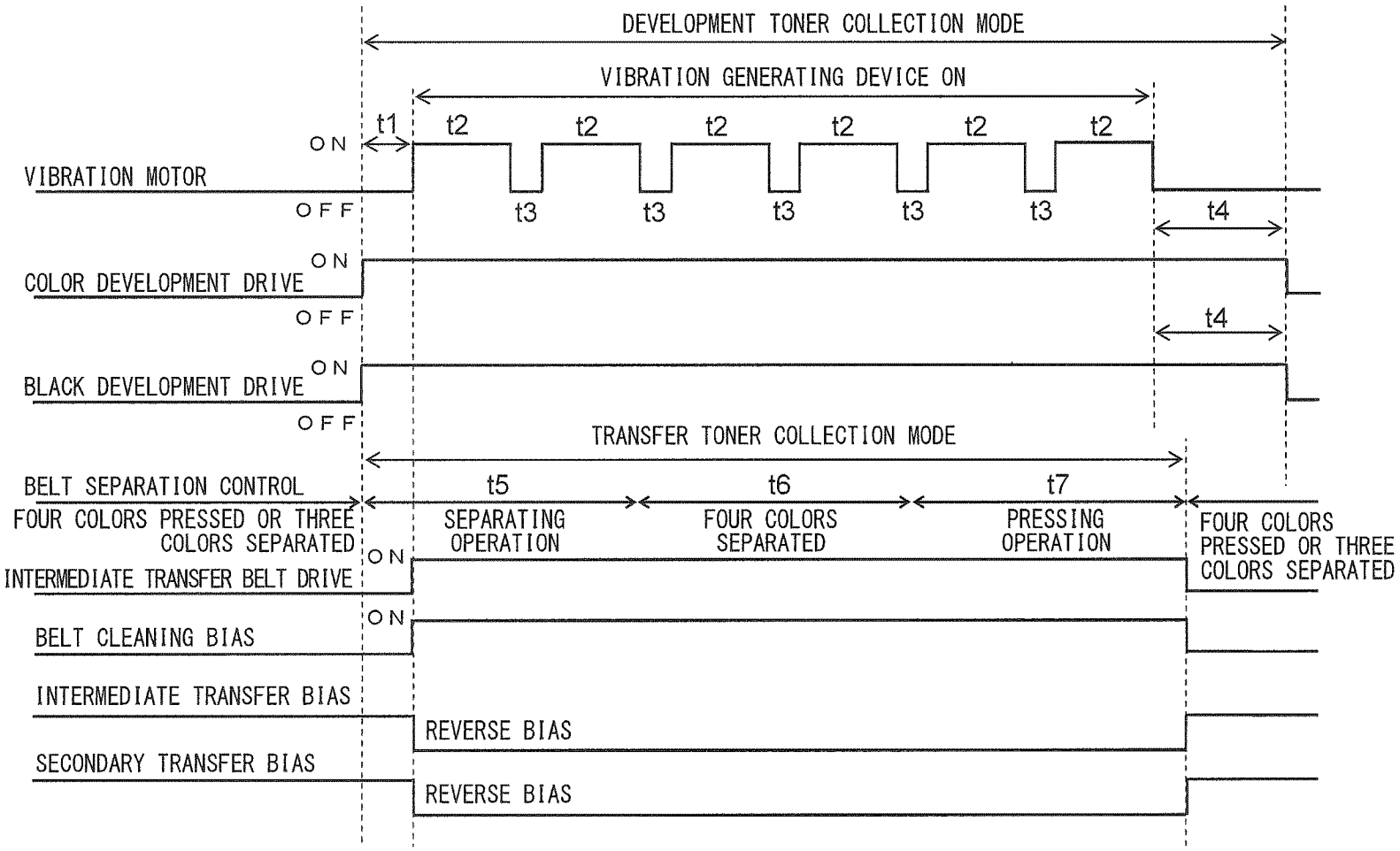
FIG. 9 is a timing chart illustrating operations in a development toner collection mode and a transfer toner collection mode in the image forming apparatus of the first embodiment.

FIG. 9 is a timing chart illustrating operations in the development toner collection mode and the transfer toner collection mode in the image forming apparatus 100 of the first embodiment. Used as a testing machine was a color printer (Ecosys P6040, a product of KYOCERA Document Solutions Inc.) as illustrated in FIG. 1, and used as the intermediate transfer belt 8 was an elastic belt (a product of Okura Industrial Co., Ltd.) composed of a base layer made of poly vinylidene difluoride (PVDF), a urethane elastic layer laid over the base layer, and a coat layer made of polytetrafluoroethylene (PTFE) laid over the elastic layer. As already described above, in the withdrawal mode, the distance between the intermediate transfer belt 8 and each of the photosensitive drums 1*a* to 1*d* increases from the photosensitive drum 1*d* side toward the photosensitive drum 1*a* side, and in the present embodiment, the intermediate transfer belt 8 is separated from the photosensitive drum 1*a* to 1*c*, but the intermediate transfer belt 8 is in contact with the photosensitive drum 1*d*.

The belt cleaning unit 19 was composed of the fur brush 41 (SA-7, a product of TOEISANGYO CO., LTD.) formed of a conductive acrylic resin, the collection roller 43 a surface of which has been anodized, the blade 45 made of polyurethane rubber (1577E, a product of Bando Chemical Industries, Ltd.), and the seal member 50 made of a 0.05 mm-thick thermoplastic polyurethane (a product of Sheedom Co., Ltd) lined with a 0.3 mm-thick stainless steel foil. Constant current control was performed during cleaning of the intermediate transfer belt 8 to allow a current of 30 ρA to flow through the collection roller 43 to apply cleaning bias to the collection roller 43.

In a case where the development toner collection mode is executed, firstly, the color developing devices 3*a* to 3*c* and the black developing device 3*d* start to be driven. In the present embodiment, at the time of driving the vibration generating device 29, the toner supply roller 24 and the developing roller 25 are each made to rotate (reversely) in a direction (the clockwise direction in FIG. 3) reverse to a direction in which each of them rotate during image formation.

Next, the vibration generating device 29 is made to operate at a time when time t1 (here, 0.4 seconds) has passed since the start of the driving of the developing devices 3*a* to 3*d*, and thereby toner accumulated on the toner receiver member 28 is shaken off. The pattern of operation of the vibration generating device 29 is such that a predetermined number of cycles of operation are repeated, each cycle of operation including driving of the vibration generating device 29 for time t2 (driving period) and stopping of the vibration generating device 29 for time t3 (stoppage period). In the present embodiment, t2 is 0.6 seconds and t3 is 0.2 seconds, such that time of one cycle (t2+t3) is 0.8 seconds, and the cycle is repeated six times.

When the toner receiver member 28 is driven to vibrate, the vibration causes toner accumulated on the toner receiver member 28 to slide down along the slope of the toner receiver member 28 to freely fall into a region between the toner receiver support member 27 and the toner supply roller 24. Part of the toner fallen from the toner receiver member 28 adheres to the magnetic brush on the toner supply roller 24. Part of the rest of the toner, which has not adhered to the magnetic brush on the toner supply roller 24, accumulates on an edge of the trimming blade 26, but is scraped off by the magnetic brush of the toner supply roller 24 rotating backward. At this time, the toner accumulated on the edge of the trimming blade 26 is scraped off with an enhanced effect by adjusting magnetic force of a magnetic pole (regulation pole) of a stationary magnet body facing the trimming blade 26 so as to elongate bristles of the magnetic brush formed on the toner supply roller 24.

The toner adhered to the magnetic brush on the toner supply roller 24 rotates together with the surface of the toner supply roller 24 to pass through a gap between the toner supply roller 24 and the trimming blade 26 to be scraped off the toner supply roller 24 at a same polarity portion of the stationary magnet body, to be then forcibly conveyed back into the supply conveyance chamber 22.

When the developing roller 25 and the toner supply roller 24 are made to rotate backward, the developer in the developing container 20 may spill out through a toner supply port, or distribution of the developer inside the developing container 20 may become uneven to cause undesired noise of a toner concentration detection sensor. To prevent these inconveniences, after the developing roller 25 and the toner supply roller 24 are made to rotate backward, the developing roller 25 and the toner supply roller 24 are preferably made to rotate (forward) in the direction same as during image formation (the counterclockwise direction in FIG. 3) continuously for a given time.

In the present embodiment, the developing roller 25 and the toner supply roller 24 are made to rotate forward continuously for time t4 (=0.5 seconds+time taken by the toner supply roller 24 to rotate eight times) after the last cycle (here, the sixth cycle) of the driving of the vibration generating device 29 is finished.

In a case of executing the transfer toner collection mode, an operation of separating the primary transfer rollers 6*a* to 6*d* from the photosensitive drums 1*a* to 1*d* is performed by moving the pressure switching roller 34 upward from the state (of the color mode) in which the four primary transfer rollers 6*a* to 6*d* (of four colors) are pressed against the photosensitive drums 1*a* to 1*d* or from the state (of the monochrome mode) in which only the primary transfer roller 6*d* is pressed against the photosensitive drum 1*d* and the other three primary transfer rollers 6*a* to 6*c* (of three colors) are separated from the photosensitive drums 1*a* to 1*c*. By this separation operation, the tension of the intermediate transfer belt 8 is released to cause the tension roller 11 to move in a direction approaching the fur brush 41 (the direction indicated by the black arrow in FIG. 7), as a result of which the fur brush 41 is pressed by the tension roller 11 to move in a direction approaching the seal member 50 and the bottom surface 40*c* of the housing 40 (the direction indicated by the white arrow in FIG. 7). In the case of the present testing machine, time t5 that the separation operation takes is two seconds in the case of separating the primary transfer rollers 6*a* to 6*d*, and 0.5 seconds in the case of separating only the primary transfer roller 6*d*.

Then, with the four primary transfer rollers 6*a* to 6*d* in the withdrawn state (the withdrawal mode), the intermediate transfer belt 8 and the belt cleaning unit 19 continue to be driven for time t6. Since the cleaning bias applied to the collection roller 43 is ON, the toner accumulated on the seal member 50 or on the bottom surface 40*c* of the housing 40 adheres to the fur brush 41 to be further collected by the collection roller 43 from the fur brush 41. Here, by giving an intermediate transfer bias applied to the intermediate transfer belt 8 and a secondary transfer bias applied to the secondary transfer roller 9 a polarity opposite to during image formation (that is, the same polarity as toner), it is possible to reduce adhesion of toner to the intermediate transfer belt 8 and to the secondary transfer roller 9. In the case of the present testing machine, time t6 is about two seconds in the color mode, and about 3.5 seconds in the monochrome mode.

Then, in preparation for a next image formation, a pressing operation is performed in which the primary transfer rollers 6*a* to 6*d* are pressed. When a color image is to be formed in the next image formation, the primary transfer rollers 6*a* to 6*d* are pressed against the photosensitive drums 1*a* to 1*d*. When a monochrome image is to be formed in the next image formation, the primary transfer roller 6*d* alone is pressed against the photosensitive drum 1*d*.

Here, even when the intermediate transfer bias is given the same polarity as toner, there are cases where some of the toner physically adheres to the intermediate transfer belt 8, or reversely charged toner electrically adheres to the intermediate transfer belt 8. With this in mind, in order to prevent toner adhered to the intermediate transfer belt 8 from affecting printing performed immediately after the pressing operation, pressing operation time t7 needs to be longer than the time taken by a given point in the intermediate transfer belt 8 to move from the belt cleaning unit 19 to the secondary transfer roller 9. In the case of the present testing machine, the distance between the belt cleaning unit 19 and the secondary transfer roller 9 was 438.8 mm, and printing was performed at a processing rate of 30 sheets/minute, it took 2.37 seconds for the given point in the intermediate transfer belt 8 to move from the belt cleaning unit 19 to the secondary transfer roller 9. Thus, time t7 was set to be about 2.5 seconds including some extra time.

Figure 10:
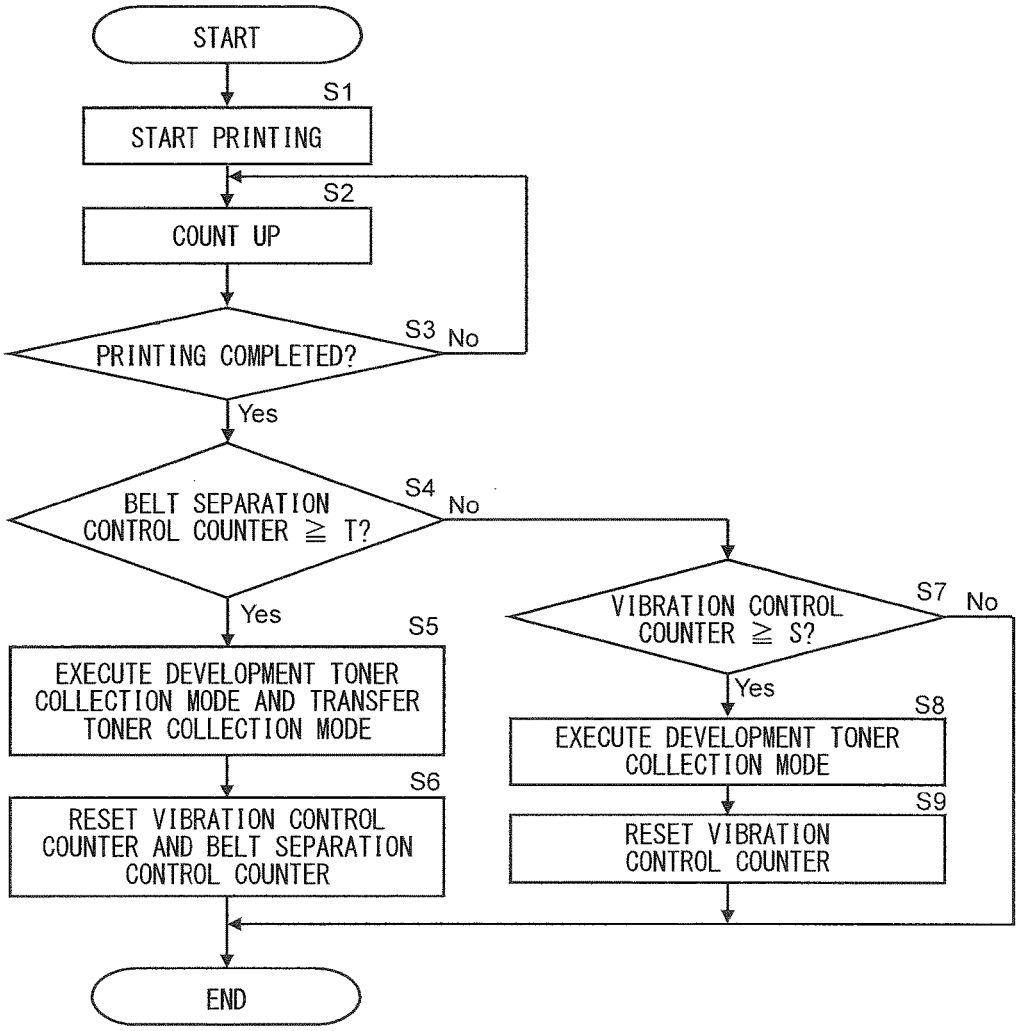
FIG. 10 is a flow chart illustrating execution procedures of the development toner collection mode and the transfer toner collection mode in the image forming apparatus of the first embodiment.

FIG. 10 is a flow chart illustrating execution procedures of the development toner collection mode and the transfer toner collection mode in the image forming apparatus 100 of the first embodiment. Referring to FIGS. 1 to 9 as necessary, a description will be given of execution procedures of the transfer toner collection mode and the development toner collection mode in the image forming apparatus 100 of the present embodiment.

When printing is started on receiving a printing instruction from a personal computer (Step S1), the control portion 90 starts counting up the number of printed sheets by means of the counter 95 (Step S2). More specifically, the counting up is performed both by the vibration control counter and by the belt separation control counter.

Next, the control portion 90 judges whether the printing has been completed (Step S3), and when the printing is found to be still being performed (No in Step S3), the process returns to Step S2, where the counting up continues to be performed. When the printing is found to have been completed (Yes in Step S3), a judgment is made on whether the belt separation control counter has counted up to a threshold value T (here, 1000 sheets) (Step S4). When the belt separation control counter is found to have counted up to the threshold value T (Yes in Step S4), the control portion 90 transmits control signals to the vibration generating device 29 and the roller contacting/separating mechanism 60, and the development toner collection mode and the transfer toner collection mode illustrated in FIG. 9 are executed simultaneously with each other (Step S5). Then, the vibration control counter and the belt separation control counter are reset (Step S6), and the process is ended.

On the other hand, when, in Step S4, the belt separation control counter is found not to have counted up to the threshold value T (No in Step S4), a judgment is made on whether the vibration control counter has counted up to a threshold value S (here, 250 sheets) (Step S7). When the vibration control counter is found to have counted up to the threshold value S (Yes in Step S7), the control portion 90 transmits a control signal to the vibration generating device 29, and only the development toner collection mode illustrated in FIG. 9 is performed (Step S8). To execute only the development toner collection mode, all that is needed is to drive the developing devices 3*a* to 3*d*, and thus driving of the intermediate transfer belt 8 and the belt cleaning unit 19 and application of the intermediate transfer bias and the secondary transfer bias become unnecessary.

Then, the vibration control counter is reset (Step S9), and the process is ended. When, in Step S7, the vibration control counter is found not to have counted up to the threshold value S (No in Step S7), the process is ended without executing either the development toner collection mode or the transfer toner collection mode.

With the above-described control, by releasing the pressing of the primary transfer rollers 6*a* to 6*d* to execute the transfer toner collection mode each time a predetermined number of sheets are printed, toner accumulated on the bottom surface 40*c* of the housing 40 or on the seal member 50 is collected by the collection roller 43 via the fur brush 41. This makes it possible to reduce movement of the toner accumulated on the bottom surface 40*c* or on the seal member 50 onto the intermediate transfer belt 8, and thus to effectively reduce falling of toner onto an image.

Further, when the transfer toner collection mode is performed, by simultaneously performing the development toner collection mode, in which accumulated toner in the developing devices 3*a* to 3*d* is shaken off, it is possible to reduce printing waiting time to achieve improved efficiency in image formation. Here, when the threshold value T (1000 sheets) of the belt separation control counter, the threshold value T determining the timing of executing the transfer toner collection mode, is set to be an integral multiple (quadruple) of the threshold value S (250 sheets) of the vibration control counter, the threshold value S determining the timing of executing the development toner collection mode, the transfer toner collection mode is always performed simultaneously with the development toner collection mode, and thus it is possible to reduce the printing waiting time.

Since the threshold value T of the belt separation control counter is set to 1000 sheets and the threshold value S of the vibration control counter is set to 250 sheets here, the transfer toner collection mode is executed once each time the development toner collection mode has been executed four times. However, the threshold value S of the number of printed sheets for executing the development toner collection mode depends on factors including temperature of inside the image forming apparatus 100 and the number of sheets printed in continuous printing, and this sometimes causes a lag in execution timing between the transfer toner collection mode and the development toner collection mode. In that case, too, as illustrated in FIG. 10, at a time when the belt separation control counter has counted up to the threshold value T, the development toner collection mode and the transfer toner collection mode are executed simultaneously with each other, and the vibration control counter and the belt separation control counter are reset.

An appropriate value for the threshold value T of the belt separation control counter depends on printing ratio, such that the higher the printing ratio is, the larger amount of toner is collected by the belt cleaning unit 19, and thus the smaller the threshold value T becomes. By inputting, via the operation portion 70, the threshold value T corresponding to the most frequently used printing ratio, it is possible to set the most appropriate execution timing for the transfer toner collection mode in accordance with usage state.

Figure 11:
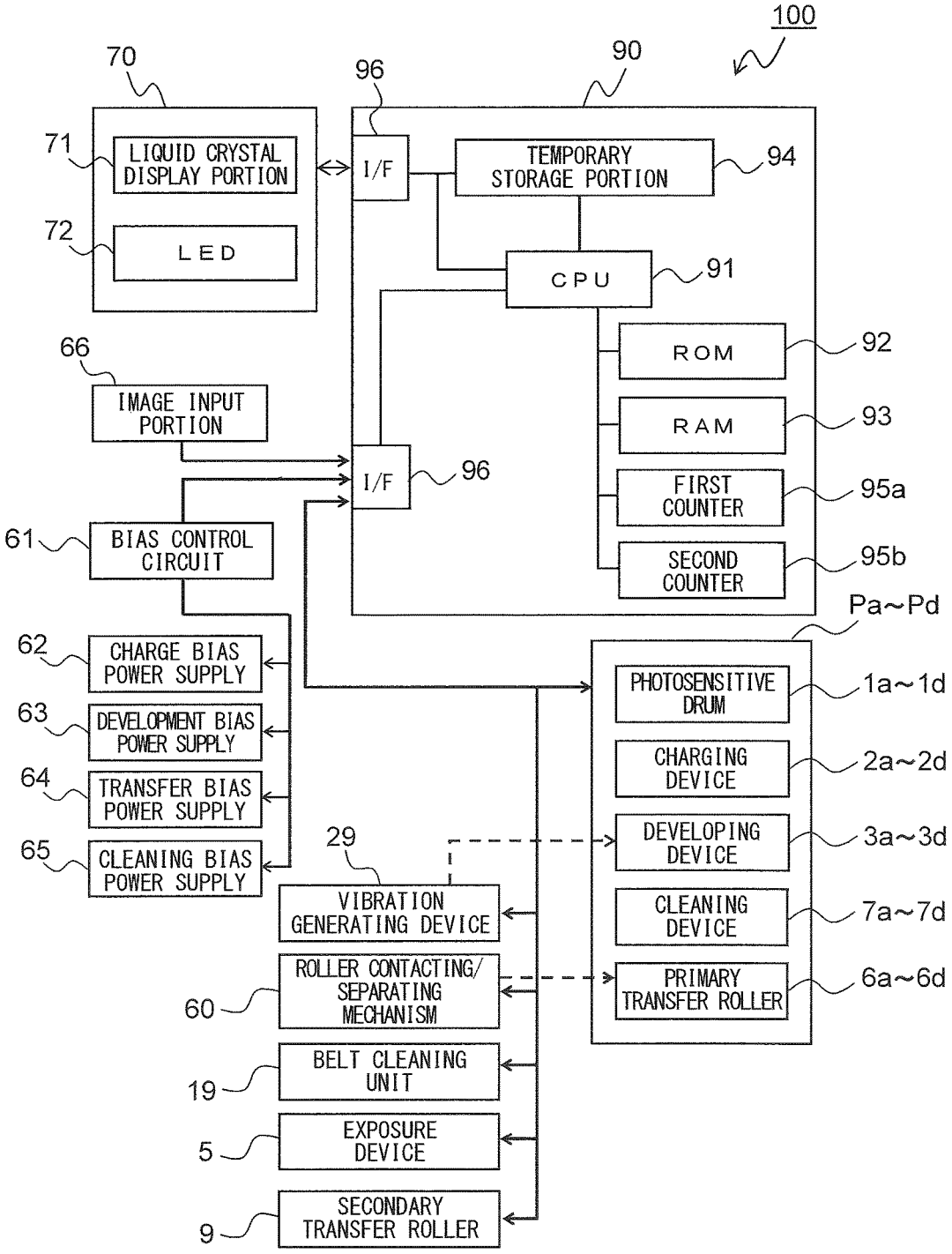
FIG. 11 is a block diagram illustrating control paths in an image forming apparatus according to a second embodiment of the present disclosure.

FIG. 11 is a block diagram illustrating control paths in an image forming apparatus 100 according to a second embodiment of the present disclosure. The image forming apparatus 100 of the present embodiment includes a first counter 95*a*, which counts the number of continuously printed sheets, and a second counter 95*b*, which counts an accumulated number of printed sheets including both those printed in continuous printing and those each printed in singly-performed printing. The first counter 95*a* includes a first vibration control counter for controlling driving of a vibration generating device 29 and a first belt separation control counter for controlling separation of an intermediate transfer belt 8 by a roller contacting/separating mechanism 60. The second counter 95*b* includes a second vibration control counter for controlling driving of the vibration generating device 29 and a second belt separation control counter for controlling separation of the intermediate transfer belt 8 by the roller contacting/separating mechanism 60. Each of the counters is capable of independently counting up and resetting the number of printed sheets. The control portion 90 executes a transfer toner collection mode and a development toner collection mode with a predetermined timing during continuous printing or after singly-performed printing is finished, based on the number of printed sheets counted by each of the first counter 95*a* and the second counter 95*b*. The other configurations of the image forming apparatus 100, such as the developing devices 3*a* to 3*d* and the belt cleaning unit 19, are the same as in the first embodiment.

Figure 12:
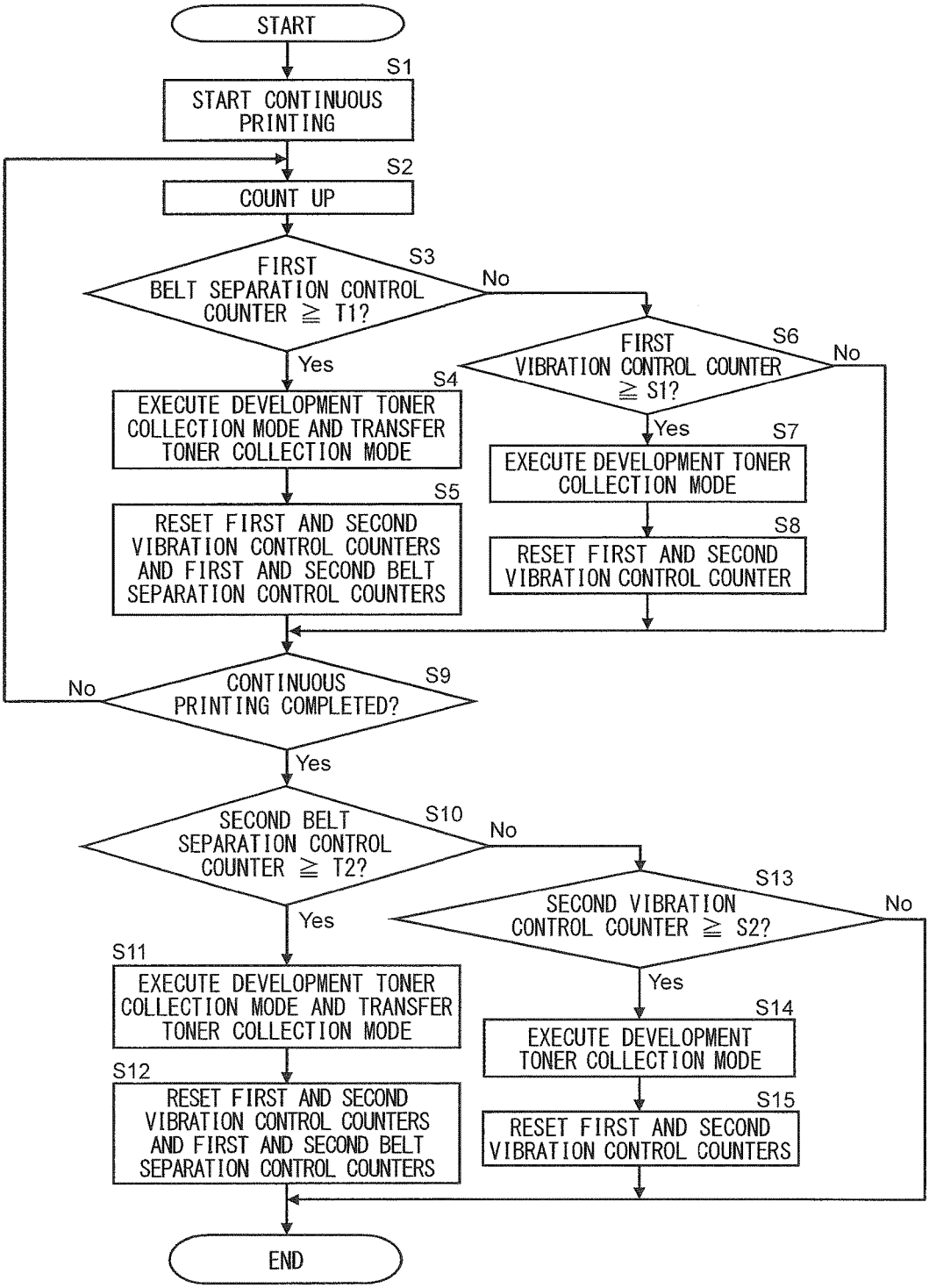
FIG. 12 is a flow chart illustrating execution procedures of a development toner collection mode and a transfer toner collection mode in the image forming apparatus of the second embodiment.

FIG. 12 is a flow chart illustrating execution procedures of the development toner collection mode and the transfer toner collection mode in the image forming apparatus 100 of the second embodiment. With reference to FIGS. 1 to 7, 9, and 11 as necessary, a description will be given of execution procedures of the transfer toner collection mode and the development toner collection mode in the image forming apparatus 100 of the present embodiment.

When continuous printing starts to be performed on receiving a printing instruction from a personal computer (Step S1), the control portion 90 makes the counter 95 start counting up the number of printed sheets (Step S2). More specifically, in the first counter 95*a*, the first vibration control counter and the first belt separation control counter each perform the counting up, and in the second counter 95*b*, the second vibration control counter and the second belt separation control counter each perform the counting up.

Next, the control portion 90 makes a judgment on whether the first belt separation control counter of the first counter 95*a* has counted up to a threshold value T1 (here, 300 sheets) (Step S3). When the first belt separation control counter is found to have counted up to the threshold value T1 (Yes in Step S3), the control portion 90 transmits control signals to the vibration generating device 29 and the roller contacting/separating mechanism 60, and the development toner collection mode and the transfer toner collection mode illustrated in FIG. 9 are executed simultaneously with each other (Step S4). Then, the first vibration control counter and the first belt separation control counter are reset, and the second vibration control counter and the second belt separation control counter are also reset (Step S5).

On the other hand, when, in Step S3, the first belt separation control counter is found not to have counted up to the threshold value T1 (No in Step S3), a judgment is made on whether the first vibration control counter has counted up to a threshold value S1 (here, 100 sheets) (Step S6). When the first vibration control counter is found to have counted up to the threshold value S1 (Yes in Step S6), the control portion 90 transmits a control signal to the vibration generating device 29, and only the development toner collection mode illustrated in FIG. 9 is executed (Step S7). To execute only the development toner collection mode, all that is needed is to drive the developing devices 3*a* to 3*d*, and thus driving of the intermediate transfer belt 8 and the belt cleaning unit 19 and application of the intermediate transfer bias and the secondary transfer bias become unnecessary. Then, the first vibration control counter and the second vibration control counter are reset (Step S8).

Next, the control portion 90 judges whether the continuous printing has been completed (Step S9), and when the continuous printing is found to be still being performed (No in Step S9), the process returns to Step S2, where the counting up is continued. When the continuous printing is found to have been completed (Yes in Step S9), a judgment is made on whether the second belt separation control counter of the second counter 95*b* has counted up to a threshold value T2 (here, 300 sheets) (Step S10).

When the second belt separation control counter of the second counter 95*b* is found to have counted up to the threshold value T2 (Yes in Step S10), the control portion 90 transmits control signals to the vibration generating device 29 and the roller contacting/separating mechanism 60, the development toner collection mode and the transfer toner collection mode illustrated in FIG. 9 are executed simultaneously with each other (Step S11). Then, the first vibration control counter and the first belt separation control counter are reset, and the second vibration control counter and the second belt separation control counter are also reset (Step S12).

When, in Step S10, the second belt separation control counter of the second counter 95*b* is found not to have counted up to the threshold value T2 (No in Step S10), a judgment is made on whether the second vibration control counter has counted up to the threshold value S2 (here, 100 sheets) (Step S13). When the second vibration control counter is found to have counted up to the threshold value S2 (Yes in Step S13), the control portion 90 transmits a control signal to the vibration generating device 29, and only the development toner collection mode illustrated in FIG. 9 is executed (Step S14). To execute only the development toner collection mode, all that is needed is to drive the developing devices 3*a* to 3*d*, and thus driving of the intermediate transfer belt 8 and the belt cleaning unit 19 and application of the intermediate transfer bias and the secondary transfer bias become unnecessary.

Then, the first vibration control counter and the second vibration control counter are reset (Step S15). When, in Step S7, the vibration control counter is found not to have counted up to the threshold value S2 (No in Step S13), the process is ended without executing either the development toner collection mode or the transfer toner collection mode.

According to the above-described control, when the number of sheets that have been printed by the end of printing is greater than a predetermined number, the transfer toner collection mode is executed, and also, when the number of sheets printed in continuous printing has reached the predetermined number, the printing is discontinued to execute the transfer toner collection mode. Thus, in a case where a large number of sheets have been printed in continuous printing, the transfer toner collection mode is executed without waiting for completion of the continuous printing, and this contributes to more effective reduction of falling of toner onto an image. Further, like in the first embodiment, by simultaneously performing the development toner collection mode when the transfer toner collection mode is performed, it is possible to reduce printing waiting time to achieve improved efficiency in image formation.

Here, since the threshold values T1 and T2 of the first and second belt separation control counters are both set to 300 sheets and the threshold values S1 and S2 of the first and second vibration control counters are both set to 100 sheets, the transfer toner collection mode is executed once each time the development toner collection mode has been executed three times. However, the threshold values S1 and S2 of the number of printed sheets to trigger the execution of the development toner collection mode depends on factors including temperature of inside the image forming apparatus 100 and the number of continuously printed sheets, and this sometimes causes a lag in execution timing between the transfer toner collection mode and the development toner collection mode. In that case, too, as illustrated in FIG. 12, at a time when the first and second belt separation control counters have counted up to the threshold values T1 and T2, respectively, the development toner collection mode and the transfer toner collection mode are executed simultaneously with each other, and the first and second vibration control counters and the first and second belt separation control counters are reset.

Further, when the threshold values T1 and T2 (300 sheets) of the first and second belt separation control counters are set to be an integral multiple (triple) of the threshold values S1 and S2 (100 sheets) of the first and second vibration control counters, the threshold values S1 and S2 determining the timing of executing the development toner collection mode, the transfer toner collection mode is always performed simultaneously with the development toner collection mode, and thus it is possible to reduce the printing waiting time like in the first embodiment. Although the setting is T1=3×S1 and T2=3×S2 (coefficient; 3), by separately setting the coefficient to "2" for S1 and "3" for S2, for example, it is also possible to make the ratio of T1 to S1 different from that of T2 to S2.

Figure 13:
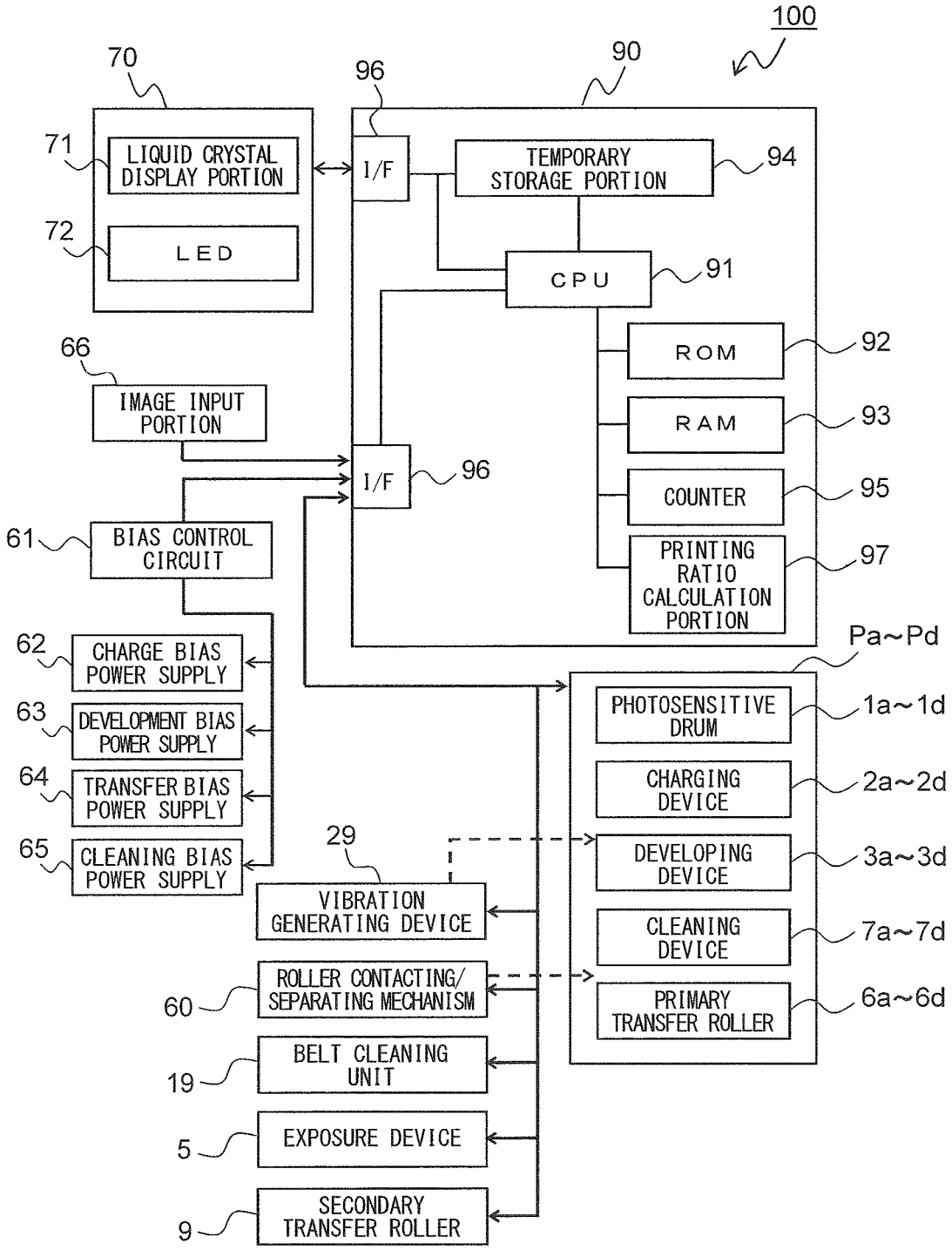
FIG. 13 is a block diagram illustrating control paths in an image forming apparatus according to a third embodiment of the present disclosure.

FIG. 13 is a block diagram illustrating control paths in an image forming apparatus 100 according to a third embodiment of the present disclosure. The image forming apparatus 100 of the present embodiment includes a printing ratio calculation portion 97, which calculates printing ratios of printed sheets based on image signals stored in a temporary storage portion 94, and calculates an accumulated printing ratio by adding up the printing ratios. Based on the accumulated printing ratio thus calculated by the printing ratio calculation portion 97, a control portion 90 executes a transfer toner collection mode with a predetermined timing after printing is completed, and also performs a development toner collection mode based on a number of printed sheets counted by a counter 95. The other configurations of the image forming apparatus 100, such as the developing devices 3*a* to 3*d* and the belt cleaning unit 19, are the same as in the first embodiment.

Figure 14:
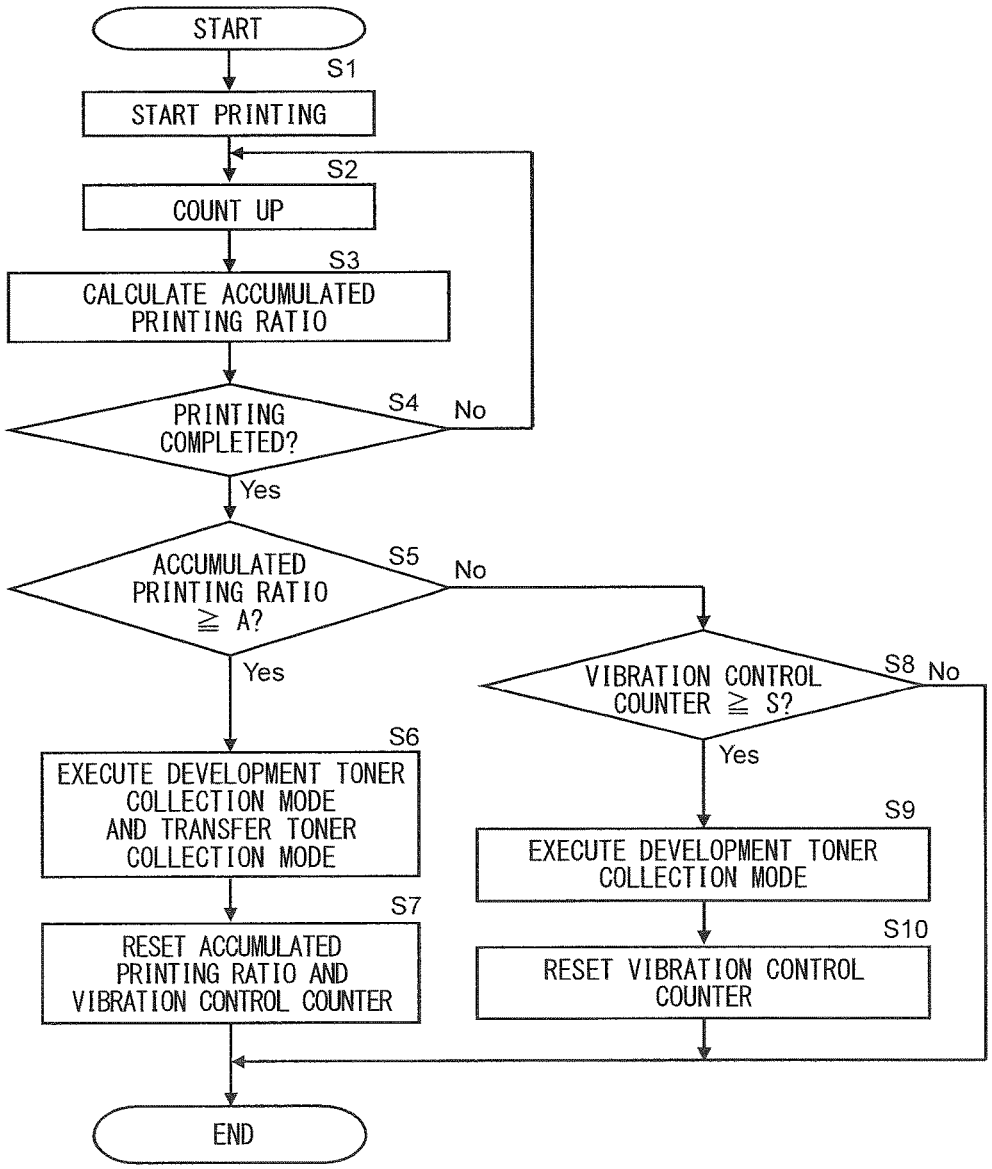
FIG. 14 is a flow chart illustrating execution procedures of a development toner collection mode and a transfer toner collection mode in the image forming apparatus of the third embodiment.

FIG. 14 is a flow chart illustrating execution procedures of the development toner collection mode and the transfer toner collection mode in the image forming apparatus 100 of the third embodiment of the present disclosure. With reference to FIGS. 1 to 9, and 13 as necessary, a description will be given of execution procedures of the transfer toner collection mode and the development toner collection mode in the image forming apparatus 100 of the present embodiment.

When printing is started on receiving a printing instruction from a personal computer (Step S1), the control portion 90 starts counting up the number of printed sheets by means of the counter 95 (Step S2). In the present embodiment, as will be described later, separation of an intermediate transfer belt is controlled based on the accumulated printing ratio, and thus no belt separation control counter is provided, so that only the vibration control counter performs counting up. Further, the printing ratio calculation portion 97 starts calculation of the accumulated printing ratio of images of all the colors (Step S3).

Next, the control portion 90 judges whether printing has been completed (Step S4), and when the printing is found to be still being performed (No in Step S4), the process returns to Step S2, where counting up and the calculation of accumulated printing ratio continue to be performed. When the printing is found to have been completed (Yes in Step S4), a judgment is made on whether the accumulated printing ratio has reached a threshold value A (Step S5).

For example, in a case where an average printing ratio of each color is 4% (16% in four colors), the amount of toner supplied to each of photosensitive drums 1*a* to 1*d* from a corresponding one of developing devices 3*a* to 3*d* is 4 mg, and accordingly 16 mg in total, for each sheet. Let the primary transfer from the photosensitive drums 1*a* to 1*d* to the intermediate transfer belt 8 be performed with an efficiency of 90%, and let the secondary transfer from the intermediate transfer belt 8 to a transfer sheet P be 90%, then toner of an amount of 1.44 (=16×0.9×0.1) mg remains on the intermediate transfer belt 8, such that the amount of toner collected by the belt cleaning unit 19 is about 1.4 mg from each sheet.

Further, when the amount of toner collected by the belt cleaning unit 19 reaches about 430 mg, toner accumulated on a bottom surface 40*c* of a housing 40 or on a seal member 50 adheres to a fur brush 41 again, and starts moving onto the intermediate transfer belt 8. In the case where the average printing ratio of each color is 4%, it is after about 300 sheets are printed that the amount of collected toner reaches 430 mg, and thus, the threshold value A is set to be 4800%, obtained by 4(%)×4 (colors)×300 (sheets).

When the accumulated printing ratio is found to have reached the threshold value A (Yes in Step S5), the control portion 90 transmits control signals to a vibration generating device 29 and a roller contacting/separating mechanism 60, and the development toner collection mode and the transfer toner collection mode are executed simultaneously with each other (Step S6). In the case where the average printing ratio of each color is 4%, the transfer toner collection mode and the development toner collection mode are executed once each time printing has been performed on about 300 sheets. In a case where the average printing ratio of each color is 12%, the transfer toner collection mode and the development toner collection mode are executed each time printing has been performed on 100 sheets (=4800/(12×4)). Then, the accumulated printing ratio and the vibration control counter are reset (Step S7), and the process is ended.

When, in Step S5, the accumulated printing ratio is found not to have reached the threshold value A (No in Step S5), a judgment is made on whether the vibration control counter has counted up to a threshold value S (here, 100 sheets) (Step S8). When the vibration control counter is found to have counted up to the threshold value S (Yes in Step S8), the control portion 90 transmits a control signal to the vibration generating device 29, and only the development toner collection mode illustrated in FIG. 9 is executed (Step S9). To execute only the development toner collection mode, all that is needed is to drive the developing devices 3*a* to 3*d*, and thus driving of the intermediate transfer belt 8 and the belt cleaning unit 19 and application of the intermediate transfer bias and the secondary transfer bias become unnecessary.

Then, the vibration control counter is reset (Step S10), and the process is ended. When, in Step S7, the vibration control counter is found not to have counted up to the threshold value S (No in Step S8), the process is ended without executing either the development toner collection mode or the transfer toner collection mode.

According to the above-described control, the timing of executing the transfer toner collection mode is determined based on the accumulated printing ratio, and this helps remove toner accumulated on the bottom surface 40*c* of the housing 40 or on the seal member 50 with a timing appropriate in accordance with the amount of toner to be collected to the belt cleaning unit 19. Thus, it is possible to prevent falling of toner onto an image with a minimum reduction in image forming efficiency. Further, driving time of the photosensitive drums 1*a* to 1*d* is also reduced, and this makes it possible to minimize abrasion of photosensitive layers of the photosensitive drums 1*a* to 1*d* caused by friction with a cleaning blade 32 and a rubbing roller 33 (see FIG. 2 for both). Further, in the present embodiment, the intermediate transfer belt 8 and the photosensitive drum 1*d* are in contact with each other in the withdrawal mode, too, and thus, by minimizing frequency with which the transfer toner collection mode is executed, it is possible to reduce generation of longitudinal lines in the photosensitive layer of the photosensitive drum 1*d* caused by friction against the intermediate transfer belt 8.

Here, the number of printed sheets to trigger the execution of the transfer toner collection mode depends on the printing ratio of each sheet, and the threshold value S of the number of printed sheets to trigger the execution of the development toner collection mode depends on factors including temperature of inside the image forming apparatus 100 and the number of continuously printed sheets, and this sometimes causes a lag in execution timing between the transfer toner collection mode and the development toner collection mode. In that case, too, as illustrated in FIG. 13, at a time when the accumulated printing ratio has reached the threshold value A, the development toner collection mode and the transfer toner collection mode are executed simultaneously with each other, and the vibration control counter is reset.

Figure 15:
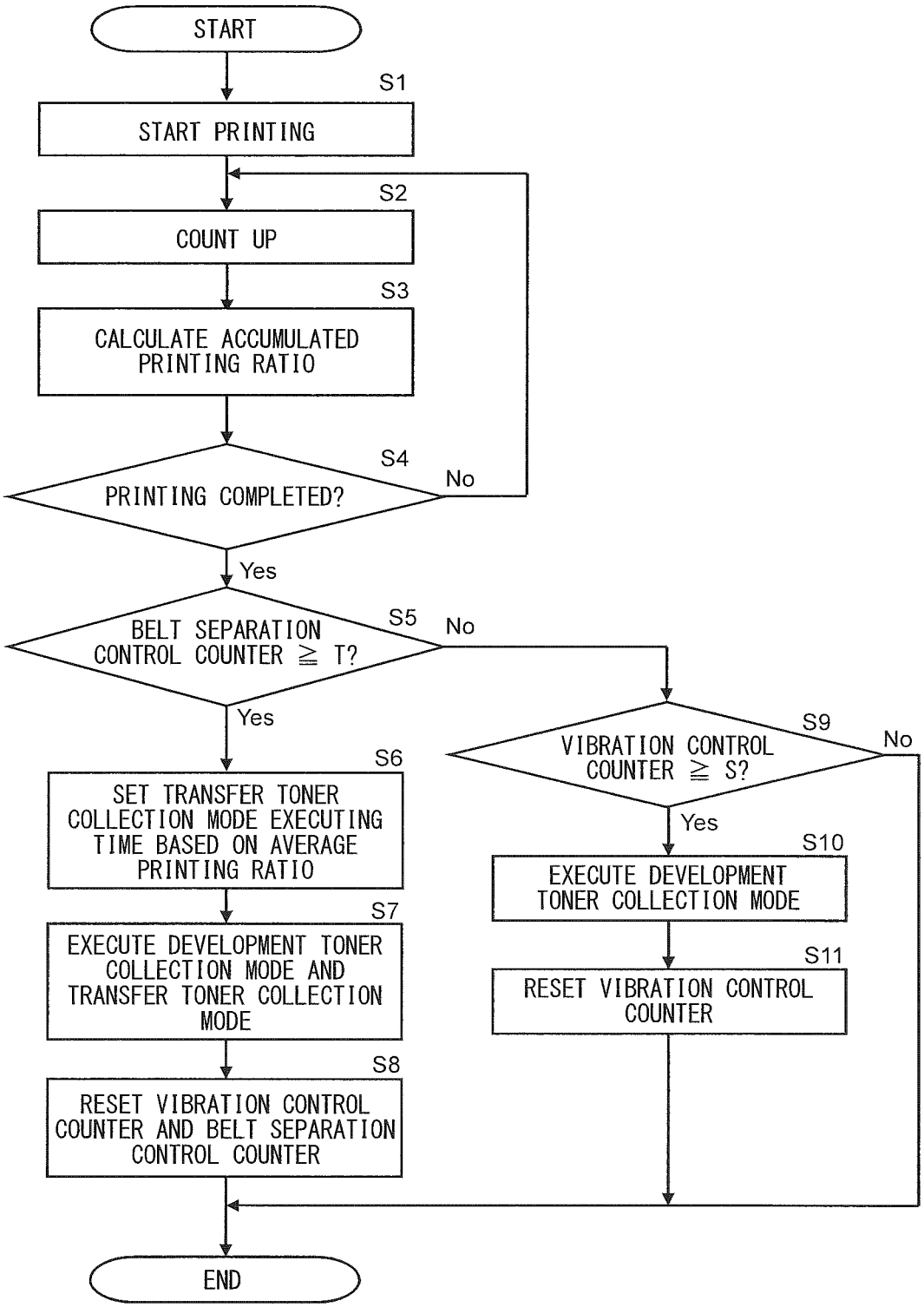
FIG. 15 is a flow chart illustrating execution procedures of a development toner collection mode and a transfer toner collection mode in an image forming apparatus of a fourth embodiment of the present disclosure.

FIG. 15 is a flow chart illustrating execution procedures of a development toner collection mode and a transfer toner collection mode in an image forming apparatus 100 of a fourth embodiment of the present disclosure. The other configurations of the image forming apparatus 100, such as the developing devices 3*a* to 3*d* and the belt cleaning unit 19, and the control paths in the image forming apparatus 100 are the same as in the third embodiment. With reference to FIGS. 1 to 9, and 13 as necessary, a description will be given of the execution procedures of the transfer toner collection mode and the development toner collection mode in the image forming apparatus 100 of the present embodiment.

When printing is started on receiving a printing instruction from a personal computer (Step S1), a control portion 90 starts counting up the number of printed sheets by means of a counter 95 (Step S2). More specifically, the counting up is performed both by a vibration control counter and by a belt separation control counter. Further, calculation of the accumulated printing ratio of images of all the colors is also started simultaneously (Step S3).

Next, the control portion 90 makes a judgment on whether printing has been completed (Step S4), and when the printing is found to be still being performed (No in Step S4), the process returns to Step S2, where counting up and the calculation of accumulated printing ratio continue to be performed. When the printing is found to have been completed (Yes in Step S4), a judgment is made on whether the belt separation control counter has counted up to a threshold value T (here, 300 sheets) (Step S5). When the belt separation control counter is found to have counted up to the threshold value T (Yes in Step S5), the control portion 90 sets execution time of the transfer toner collection mode based on the average printing ratio obtained by dividing the accumulated printing ratio by the number of printed sheets counted by the belt separation control counter (Step S6).

For example, in a case where the average printing ratio of each color is 4% (16% in four colors), the amount of toner supplied to the photosensitive drums 1*a* to 1*d* from the developing devices 3*a* to 3*d* is 4 mg, and accordingly 16 mg in total, for each sheet. Let the primary transfer from the photosensitive drums 1*a* to 1*d* to the intermediate transfer belt 8 be performed with an efficiency of 90%, and let the secondary transfer from the intermediate transfer belt 8 to a transfer sheet P be performed with an efficiency of 90%, then toner of an amount of 1.44 mg (=16×0.9×0.1) remains on the intermediate transfer belt 8, such that the amount of toner collected by the belt cleaning unit 19 is about 1.4 mg from each sheet.

Further, when the amount of toner collected by the belt cleaning unit 19 reaches about 430 mg, toner accumulated on a bottom surface 40*c* of a housing 40 or on a seal member 50 adheres to a fur brush 41 again, and starts moving onto the intermediate transfer belt 8. In the case where the average printing ratio of each color is 4%, it is after about 300 sheets are printed that the amount of collected toner reaches 430 mg, and thus, the threshold value T is set to 300 sheets. Further, in the color mode, the execution time of the transfer toner collection mode illustrated in FIG. 9 is set to about 6.5 seconds (=t5+t6+t7=2 seconds+2 seconds+2.5 seconds).

Since a higher average printing ratio leads to a larger amount of toner collected by the belt cleaning unit 19, when the execution time of the transfer toner collection mode is about 6.5 seconds, it is difficult to securely collect toner accumulated on the bottom surface 40*c* of the housing 40 and on the seal member 50. With this in mind, in the present embodiment, the execution time of the transfer toner collection mode is changed in accordance with the average printing ratio.

For example, in a case where the average printing ratio of each color is 8% (32% in the four colors), the execution time of the transfer toner collection mode is set to 10 seconds. Further, in a case where the average printing ratio of each color is 12% (48% in the four colors), the execution time of the transfer toner collection mode is set to 13.5 seconds. In these cases, without changing time t5 (two seconds) necessary for the operation of separating the primary transfer rollers 6*a* to 6*d* from the photosensitive drums 1*a* to 1*d* or time t7 (2.5 seconds) necessary for the pressing operation of pressing the primary transfer rollers 6*a* to 6*d* toward the photosensitive drums 1*a* to 1*d*, with the primary transfer rollers 6*a* to 6*d* separated from the photosensitive drums 1*a* to 1*d* (the withdrawal mode), time t6 (two seconds) during which the intermediate transfer belt 8 and the belt cleaning unit 19 continue to be driven is prolonged to 5.5 seconds in the former case, and nine seconds in the latter case.

Then, the control portion 90 transmits control signals to the vibration generating device 29 and the roller contacting/separating mechanism 60, and the development toner collection mode and the transfer toner collection mode illustrated in FIG. 9 are executed simultaneously with each other (Step S7). Then, the belt separation control counter and the vibration control counter are reset (Step S8), and the process is ended.

On the other hand, when, in Step S5, the belt separation control counter is found not to have counted up to the threshold value T (No in Step S5), a judgment is made on whether the vibration control counter has counted up to a threshold value S (here, 100 sheets) (Step S9). When the vibration control counter is found to have counted up to the threshold value S (Yes in Step S9), the control portion 90 transmits a control signal to the vibration generating device 29, and only the development toner collection mode illustrated in FIG. 9 is executed (Step S10). To execute only the development toner collection mode, all that is needed is to drive the developing devices 3*a* to 3*d*, and thus driving of the intermediate transfer belt 8 and the belt cleaning unit 19 and application of the intermediate transfer bias and the secondary transfer bias become unnecessary.

Then, the vibration control counter is reset (Step S11), and the process is ended. When, in Step S9, the vibration control counter is found not to have counted up to the threshold value S (No in Step S9), the process is ended without executing either the development toner collection mode or the transfer toner collection mode.

According to the above-described control, the execution time of the transfer toner collection mode is determined based on the average printing ratio, and this makes it possible to securely remove toner accumulated on the bottom surface 40*c* of the housing or on the seal member 50 by continuing the execution of the transfer toner collection mode for an appropriate time in accordance with the amount of toner collected to the belt cleaning unit 19. Thus, it is possible to prevent falling of toner onto an image with a minimum reduction in image forming efficiency. It is also possible to reduce not only abrasion of the photosensitive layers of the photosensitive drums 1*a* to 1*d* caused by friction with attic cleaning blade 32 and the rubbing roller 33, but also longitudinal lines caused by contact with the intermediate transfer belt 8. It should be noted that although the execution time of the transfer toner collection mode is determined based on the average printing ratio here, it is also possible to determined the execution time of the transfer toner collection mode based on the accumulated printing ratio.

It should be understood that the present disclosure is not limited to the above embodiments, and various modifications are possible within the scope of the present disclosure. For example, although the above-described embodiments each deal with a configuration where the belt cleaning unit 19 includes the fur brush 41, the present disclosure is equally applicable to a configuration where a cleaning roller is used instead of the fur brush 41.

Further, in the above-described embodiments, the transfer toner collection mode is executed in synchronization with the development toner collection mode of the developing devices 3*a* to 3*d*, but this is not meant to limit the present disclosure, and the transfer toner collection mode may be executed in synchronization with another control of the image forming apparatus 100. For example, in a case where the image forming apparatus 100 has, as control modes to be executed while image formation is not being performed, a cleaning mode of cleaning the light emitting window 5*a* of the exposure device 5, a toner supply mode of forcibly supplying toner from the toner containers 4*a* to 4*d* into the developing devices 3*a* to 3*d* immediately before the toner containers 4*a* to 4*d* become empty, and a toner discharge mode of forcibly discharging toner on the developing rollers 25 in the developing devices 3*a* to 3*d* onto the photosensitive drums 1*a* to 1*d*, it is possible to execute the transfer toner collection mode in synchronization with at least one of the cleaning mode, the toner supply mode, and the toner discharge mode. It is also possible to execute the transfer toner collection mode when a non-sheet-feeding state is brought about in which no sheet is left in a sheet cassette 16.

Application of the present disclosure is not limited to the tandem color printer as illustrated in FIG. 1, but the present disclosure is applicable to various image forming apparatuses, such as color copiers and color multifunction peripherals, incorporating an intermediate transfer belt and a belt cleaning device.

The present disclosure can be used in an image forming apparatus incorporating a mechanism that removes residual toner from the surface of an intermediate transfer belt by using a cleaning member. The present disclosure makes it possible to provide an image forming apparatus capable of effectively preventing toner removed from the surface of the intermediate transfer belt by using a cleaning member from adhering to the intermediate transfer belt again.

What is claimed is:

1. An image forming apparatus comprising:

a plurality of image forming portions which form images of different colors;

an intermediate transfer unit including an intermediate transfer belt which has an endless shape and moves along the image forming portions, a plurality of primary transfer members which are arranged to face image carriers arranged in the image forming portions, with the intermediate transfer belt between the primary transfer members and the image carriers, and transfer toner images formed on the image carriers onto the intermediate transfer belt, a drive roller which causes the intermediate transfer belt to turn, a tension roller which rotates following the intermediate transfer belt and gives a predetermined tension to the intermediate transfer belt, and a contacting/separating mechanism which causes the primary transfer members to reciprocate in directions toward and away from the intermediate transfer belt;

a secondary transfer member which secondarily transfers, onto a recording medium, the toner images which have been primarily transferred onto the intermediate transfer belt;

a belt cleaning device including a housing having formed therein an opening portion which faces the intermediate transfer belt and a toner storage portion for storing toner removed from a surface of the intermediate transfer belt, a cleaning member arranged at a position facing the tension roller with the intermediate transfer belt between the cleaning member and the tension roller, a collection roller which collects toner adhered to the cleaning member, and a seal member which is arranged to face the collection roller along an entire length of the collection roller and functions as a partition between the toner storage portion and the opening portion, the belt cleaning device removing residual toner on the surface of the intermediate transfer belt; and a control portion which controls driving of the intermediate transfer unit and driving of the belt cleaning device, wherein the contacting/separating mechanism is switchable between a printing mode in which at least one of the primary transfer members is pressed against one of the image carriers with the intermediate transfer belt therebetween and a withdrawal mode in which the primary transfer members are all separated from the image carriers, in the withdrawal mode, the cleaning member is moved by pressing force of the tension roller further into the housing from the opening portion as compared with in the printing mode, and the control portion is capable of executing, while image formation is not being performed, a transfer toner collection mode in which the intermediate transfer belt and the belt cleaning device are driven in the withdrawal mode to collect toner accumulated in vicinity of the opening portion of the housing by using the cleaning member and the collection roller.

2. The image forming apparatus according to claim 1, further comprising a printed-sheet number count portion which counts a number of printed sheets, wherein after a previous execution of the transfer toner collection mode, the control portion executes the transfer toner collection mode when the number of printed sheets counted by the printed-sheet number count portion has reached a predetermined number T.

3. The image forming apparatus according to claim 2, wherein the image forming portions each include a developing device which has a developing roller which is arranged to face one of the image carriers and supplies toner to the one of the image carriers in an opposing region where the developing roller faces the one of the image carriers, a toner receiver member having a toner receiving surface which receives toner fallen from the developing roller, and a vibration generating device which vibrates the toner receiver member, and develops an electrostatic latent image formed on the one of the image carriers, the image forming portions are capable of executing, while image formation is not being performed, a development toner collection mode in which the vibration generating device vibrates the toner receiver member to shake off toner accumulated on the toner receiving surface, and the control portion simultaneously executes the transfer toner collection mode and the development toner collection mode.

4. The image forming apparatus according to claim 3, wherein after a previous execution of the development toner collection mode, the control portion executes the development toner collection mode when the number of printed sheets counted by the printed-sheet number count portion has reached a predetermined number S (S<T), and the control portion simultaneously executes the transfer toner collection mode and the development toner collection mode when the number of printed sheets counted after a previous execution of the transfer toner collection mode has reached the predetermined number T before the number of printed sheets counted after a previous execution of the development toner collection mode reaches the predetermined number S.

5. The image forming apparatus according to claim 2, wherein the printed-sheet number count portion includes a first count portion which counts a number of continuously printed sheets, and a second count portion which counts an accumulated number of printed sheets including sheets printed in continuous printing and sheets each printed in singly-performed printing, and after a previous execution of the transfer toner collection mode, the control portion executes the transfer toner collection mode when a number of printed sheets counted by the first count portion has reached a predetermined number T1, or when a number of printed sheets counted by the second count portion has reached a predetermined number T2, and the control portion resets a count value of the first count portion and a count value of the second count portion after the transfer toner collection mode is executed.

6. The image forming apparatus according to claim 5, wherein the image forming portions each include a developing device which has a developing roller which is arranged to face one of the image carriers and supplies toner to the one of the image carriers in an opposing region where the developing roller faces the one of the image carriers, a toner receiver member having a toner receiving surface which receives toner fallen from the developing roller, and a vibration generating device which vibrates the toner receiver member, and develops an electrostatic latent image formed on the one of the image carriers, the image forming portions are capable of executing, while image formation is not being performed, a development toner collection mode in which the vibration generating device vibrates the toner receiver member to shake off toner accumulated on the toner receiving surface, and the control portion simultaneously executes the transfer toner collection mode and the development toner collection mode.

7. The image forming apparatus according to claim 6, wherein after a previous execution of the development toner collection mode, the control portion executes the development toner collection mode when the number of printed sheets counted by the first count portion has reached a predetermined number S1 (S1<T1) or when the number of printed sheets counted by the second count portion has reached a predetermined number S2 (S2<T2), and after a previous execution of the development toner collection mode, the control portion simultaneously executes the transfer toner collection mode and the development toner collection mode when a number of printed sheets counted by the first count portion has reached the predetermined number T1 before reaching the predetermined number S1, or when the number of printed sheets counted by the second count portion has reached a predetermined number T2 before reaching the predetermined number S2.

8. The image forming apparatus according to claim 2, wherein the image forming portions each include a developing device which has a developing roller which is arranged to face one of the image carriers, and supplies toner to the one of the image carriers in an opposing region where the developing roller faces the one of the image carriers, and develops an electrostatic latent image formed on the one of the image carriers, the image forming apparatus further includes an exposure device which irradiates the image carriers with light to form an electrostatic latent image on each of the image carriers, a toner container for storing toner to be supplied to the developing device, and a recording medium cassette for storing a recording medium onto which a toner image on the intermediate transfer belt is to be transferred, and the control portion executes the transfer toner collection mode simultaneously with at least one of exposure cleaning to clean a light emitting window of the exposure device, toner supply to supply toner to the developing device, forcible discharge of toner from the developing roller to the one of the image carriers, and occurrence of a recording-medium supply failure state in which no recording medium is left in the recording medium cassette.

9. The image forming apparatus according to claim 1, further comprising a printing ratio calculation portion which calculates a printing ratio of each sheet, wherein the control portion determines execution time of the transfer toner collection mode based on an accumulated value, or an average value, of printing ratios calculated by the printing ratio calculation portion.

10. The image forming apparatus according to claim 1, further comprising a printing ratio calculation portion which calculates a printing ratio of each sheet, wherein after a previous execution of the transfer toner collection mode, the control portion executes the transfer toner collection mode when an accumulated value of printing ratios calculated by the printing ratio calculation portion has reached a predetermined value.

11. The image forming apparatus according to claim 10, wherein the image forming portions each include a developing device which has a developing roller which is arranged to face one of the image carriers and supplies toner to the one of the image carriers in an opposing region where the developing roller faces the one of the image carriers, a toner receiver member having a toner receiving surface which receives toner fallen from the developing roller, and a vibration generating device which vibrates the toner receiver member, and develops an electrostatic latent image formed on the one of the image carriers, the image forming portions are capable of executing, while image formation is not being performed, a development toner collection mode in which the vibration generating device vibrates the toner receiver member to shake off toner accumulated on the toner receiving surface, and the control portion simultaneously executes the transfer toner collection mode and the development toner collection mode.

12. The image forming apparatus according to claim 11, further comprising a printed-sheet number count portion which counts a number of printed sheets, wherein after a previous execution of the development toner collection mode, the control portion executes the development toner collection mode when the number of printed sheets counted by the printed-sheet number count portion has reached a predetermined number, and when the accumulated value of printing ratios after a previous execution of the transfer toner collection mode has reached the predetermined value before the number of printed sheets after a previous execution of the development toner collection mode reaches a predetermined value, the control portion simultaneously executes the transfer toner collection mode and the development toner collection mode, and resets a count value of the printed-sheet count portion after the transfer toner collection mode is executed.

13. The image forming apparatus according to claim 1, wherein the transfer toner collection mode includes a separation operation to switch from the printing mode to the withdrawal mode and a pressing operation to switch from the withdrawal mode to the printing mode when a predetermined time has passed since performance of the separation operation, and a time from start to end of the pressing operation is longer than a time taken by a predetermined point in the intermediate transfer belt to move from the belt cleaning device to the secondary transfer member.

14. The image forming apparatus according to claim 1, further comprising a transfer bias application device which applies a bias to the primary transfer members and the secondary transfer member, wherein while the transfer toner collection mode is being executed, the transfer bias application device applies a bias having a same polarity as toner to the secondary transfer member and the primary transfer members.

15. The image forming apparatus according to claim 1, further comprising a cleaning bias application device which applies a bias to the collection roller, wherein the cleaning member and the collection roller are made of a conductive material, and while the transfer toner collection mode is being executed, the cleaning bias application device applies a bias having an opposite polarity to toner to the collection roller.

16. The image forming apparatus according to claim 1, wherein the printing mode includes a color mode in which all the primary transfer members are pressed against the image carriers with the intermediate transfer belt between the primary transfer members and the image carriers, and a monochrome mode in which only one of the primary transfer members is pressed against one of the image carriers that is arranged in one of the image forming portions that forms a black image, with the intermediate transfer belt between the only one of the primary transfer members and the one of the image carriers.

17. The image forming apparatus according to claim 1, wherein the intermediate transfer belt is made of a plurality of layers including an elastic layer, the layers being laid one on another.

* * * * *